US006985686B2

(12) United States Patent
Okino et al.

(10) Patent No.: US 6,985,686 B2
(45) Date of Patent: Jan. 10, 2006

(54) DEVELOPER CONTAINER INCLUDING A DEVELOPER MOVEMENT SUPPRESSION FEATURE

(75) Inventors: Ayatomo Okino, Moriya (JP); Hironori Minagawa, Moriya (JP); Tetsuo Isomura, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/924,922

(22) Filed: Aug. 25, 2004

(65) Prior Publication Data

US 2005/0053399 A1 Mar. 10, 2005

(30) Foreign Application Priority Data

Aug. 29, 2003 (JP) ..... 2003-307151

(51) Int. Cl.
*G03G 15/08* (2006.01)

(52) U.S. Cl. ..... 399/260; 399/262

(58) Field of Classification Search ..... 399/260
See application file for complete search history.

(56) References Cited

U.S. PATENT DOCUMENTS

| | | | | |
|---|---|---|---|---|
| 5,758,235 | A * | 5/1998 | Kosuge et al. | 399/227 |
| 6,067,432 | A * | 5/2000 | Huang | 399/262 |
| 6,418,290 | B1 | 7/2002 | Isomura et al. | 399/254 |
| 6,470,163 | B1 | 10/2002 | Minagawa | 399/256 |
| 6,704,533 | B2 | 3/2004 | Isomura et al. | 399/254 |
| 6,788,912 | B2 | 9/2004 | Isomura et al. | 399/254 |
| 2002/0106215 | A1 | 8/2002 | Ban et al. | 399/120 |
| 2002/0122676 | A1 | 9/2002 | Yamada et al. | 399/263 |
| 2004/0013445 | A1 | 1/2004 | Yamada et al. | 399/106 |
| 2004/0033087 | A1 | 2/2004 | Yoshikawa et al. | 399/258 |
| 2004/0052553 | A1 | 3/2004 | Isomura et al. | 399/262 |
| 2004/0223791 | A1 | 11/2004 | Yamada et al. | 399/263 |
| 2004/0234297 | A1 | 11/2004 | Yoshikawa et al. | 399/227 |

FOREIGN PATENT DOCUMENTS

| | | | |
|---|---|---|---|
| JP | 06102758 A | * | 4/1994 |
| JP | 3168722 | | 3/2001 |

* cited by examiner

*Primary Examiner*—Quana Grainger
(74) *Attorney, Agent, or Firm*—Fitzpatrick, Cella, Harper & Scinto

(57) ABSTRACT

A developer container for feeding and discharging developer by rotationally moving about a rotation axis includes a container body for containing developer and is provided with a discharge opening for permitting discharge of the developer, and developer movement suppression means disposed inside and adjacent to the discharge opening. The developer movement suppression means includes a first wall member for scooping the developer contained in the container body by rotational movement of the container body and a second wall member, disposed at an end portion of the first wall member with respect to a direction of the rotation axis, for suppressing movement of the developer scooped by the first wall member while permitting the developer to partly move from one side to the other side thereof. The second wall member is provided with an opening for permitting passage of the developer through the second wall member.

1 Claim, 26 Drawing Sheets

| No. | | STRUCTURAL MEMBER | | | | | AVERAGE DISCHARGE AMOUNT ( /REV. ) | BLOCKING | REST [g] |
|---|---|---|---|---|---|---|---|---|---|
| | | BACK WALL | SIDE WALL | TOP WALL | SIDE OPENING | BACK OPENING | | | |
| 1 | EMB.1 | ○ | ○ | × | × | ○ | 2.7g | NO | 1.5 |
| 2 | COMP.1 | ○ | ○ | ○ | × | × | 0.51g | YES | 2.4 |
| 3 | COMP.2 | × | × | × | × | × | 0.43g | YES | 1.5 |
| 4 | EMB.2 | ○ | ○ | ○ | × | ○ | 2.9g | NO | 1.6 |
| 5 | EMB.3 | ○ | ○ | ○ | ○ | ○ | 3.2g | NO | 1.5 |

FIG.22

DEVELOPER CONTAINER INCLUDING A DEVELOPER MOVEMENT SUPPRESSION FEATURE

FIELD OF THE INVENTION AND RELATED ART

The present invention relates to a developer container for supplying developer to an image forming apparatus, such as an electrophotographic copying machine or a printer.

In an image forming apparatus such as an electrophotographic copying machine or a printer, developer in the form of fine powder has been conventionally used as developer therefor. When the developer for the image forming apparatus is consumed, developer is supplied to the image forming apparatus by using a developer supply container.

The developer supply container for supplying developer to the image forming apparatus is roughly classified into two types thereof including a so-called simultaneous supply type container which supplies the entire amount of developer contained therein to a developer-receiving portion of the image forming apparatus at the same time, and a mounting type container which is mounted in a main assembly of the image forming apparatus and gradually supplies developer until the developer is used up.

In recent years, the mounting type developer supply container tends to be generally used in order to realize a compact image forming apparatus. Further, as the developer supply container described above, such a developer supply container that it is provided with a discharge opening, disposed on a peripheral surface of a cylindrical bottle, for permitting discharge of developer therefrom and supplies the developer by intermittently feeding toner while rotating the developer supply container, has been known. This developer supply container is changed in amount of discharge depending on an amount of toner remaining in the developer supply container, so that it has a poor supply stability. For this reason, Japanese Patent (JP-B) No. 3168722 has proposed such a developer supply container 500, as shown in FIG. 26, to which a measuring portion 502 for covering a discharge opening 501 is provided at an inner peripheral surface or an outer peripheral surface thereof, thus supplying the toner by feeding the toner quantitatively.

However, the above described conventional developer supply container as described in JP-B No. 3168722 is accompanied with such a problem that when toner has a large bulk density in the neighborhood of the discharge opening, the toner causes a blockage or a decrease in discharge amount at the discharge opening during the supply thereof although the developer supply container is provided with the measuring portion at the discharge opening to ensure supply of the toner in a constant amount for each supply operation with respect to such a phenomenon that the discharge amount is larger with a larger amount of developer remaining in the developer supply container and smaller with a smaller amount thereof.

SUMMARY OF THE INVENTION

An object of the present invention is to provide a developer supply container (hereinafter, simply referred to as a "developer container") capable of discharging developer smoothly by suppressing a blockage of developer even when the developer has a large bulk density in the vicinity of a discharge opening.

According to the present invention, there is provided a developer container for feeding and discharging developer by rotationally moving about a rotation axis, comprising:

a container body for containing developer and is provided with a discharge opening for permitting discharge of the developer, and developer movement suppression means disposed inside and adjacent to the discharge opening, wherein the developer movement suppression means comprises a first wall member for scooping the developer container in the container body by rotational movement of the container body and a second wall member, disposed at an end portion of the first wall member with respect to a direction of the rotation axis, for suppressing movement of the developer scooped by the first wall member while permitting the developer to partly move from one side to the other side thereof, and wherein the second wall member is provided with an opening for permitting passage of the developer through the second wall member.

This and other objects, features and advantages of the present invention will become more apparent upon a consideration of the following description of the preferred embodiments of the present invention taken in conjunction with the accompanying drawings.

Figure 3:
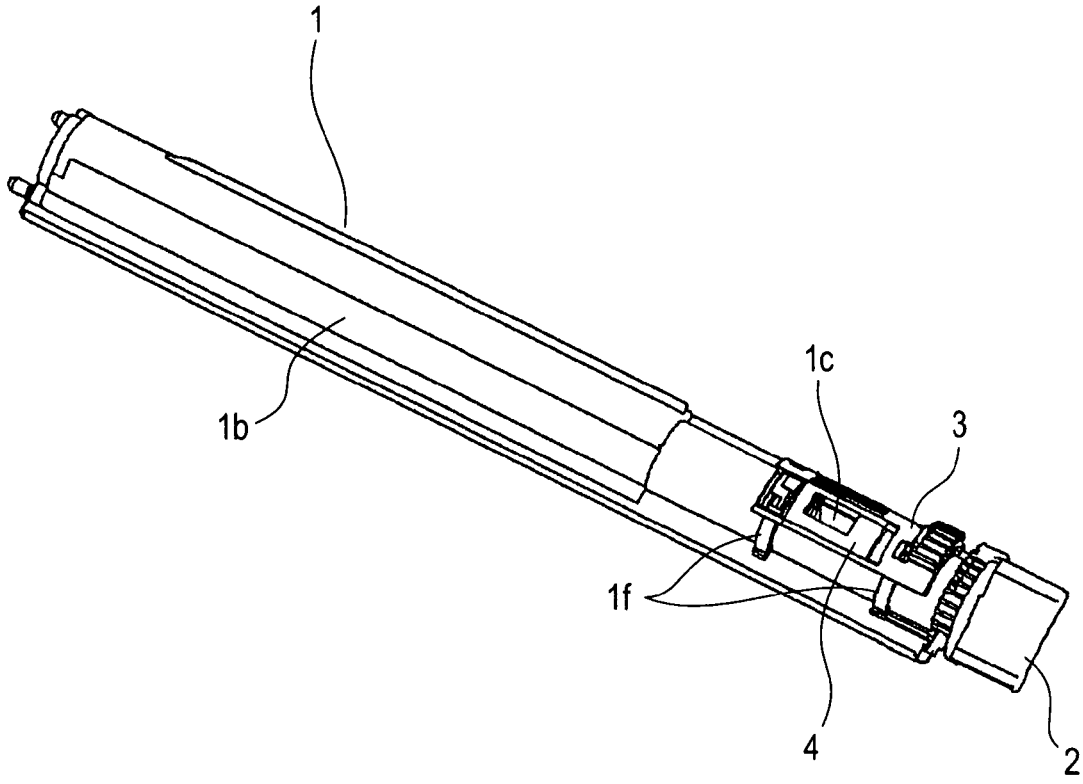
Figure 4:
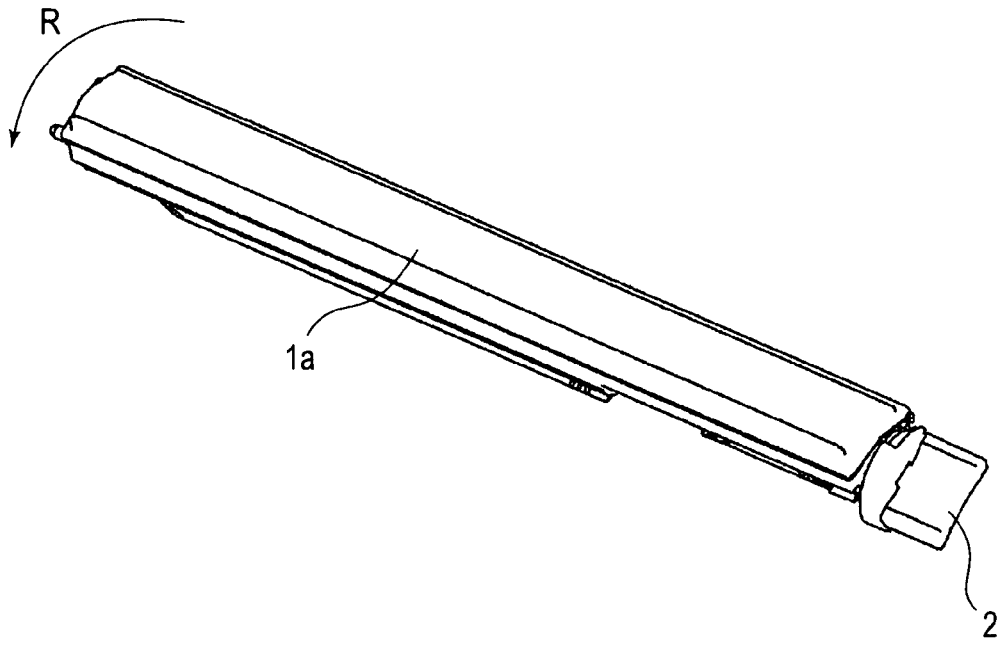

Each of FIGS. 3 and 4 is a perspective view of the developer container of the present invention.

Figure 5:
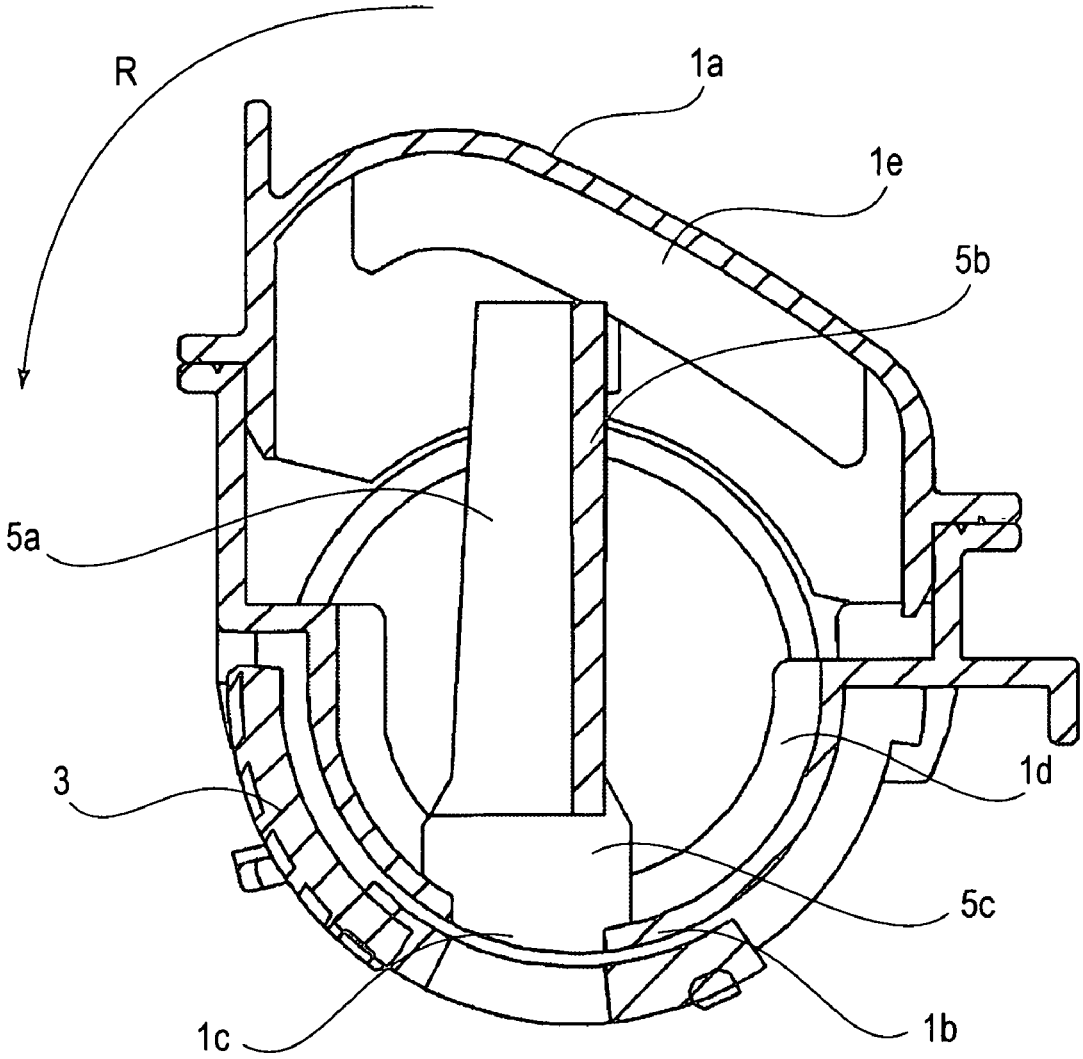

FIG. 5 is a cross-sectional view of the developer container at a central portion of a discharge opening of the developer container.

Figure 6:
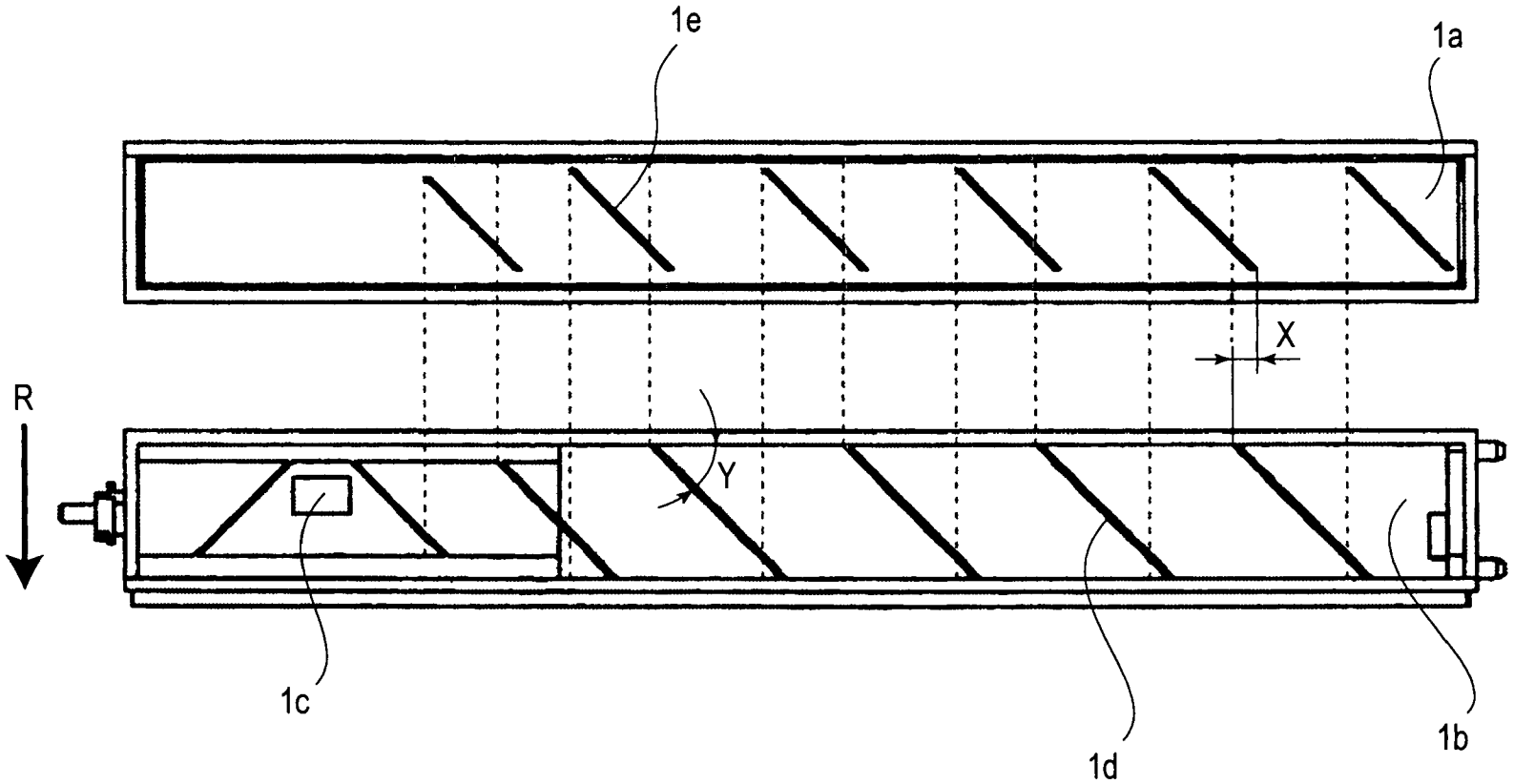

FIG. 6 is an internal plan view showing an upper member and a lower member of the developer container.

Figure 7:
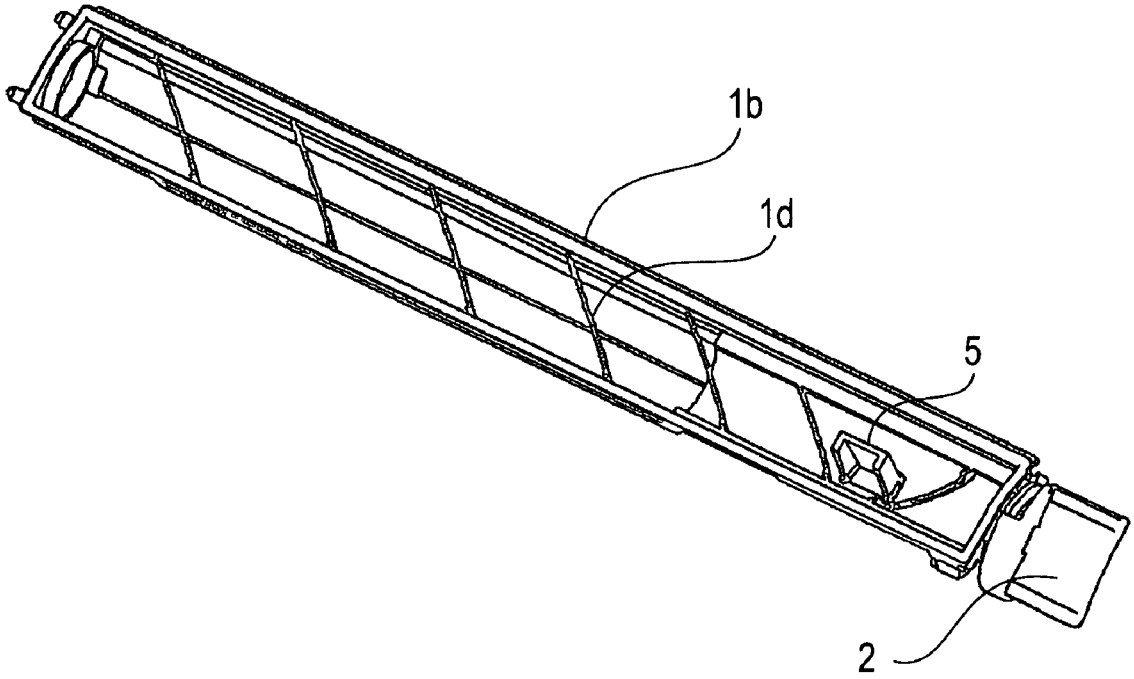

FIG. 7 is an internal perspective view of the lower member of the developer container.

Figure 8:
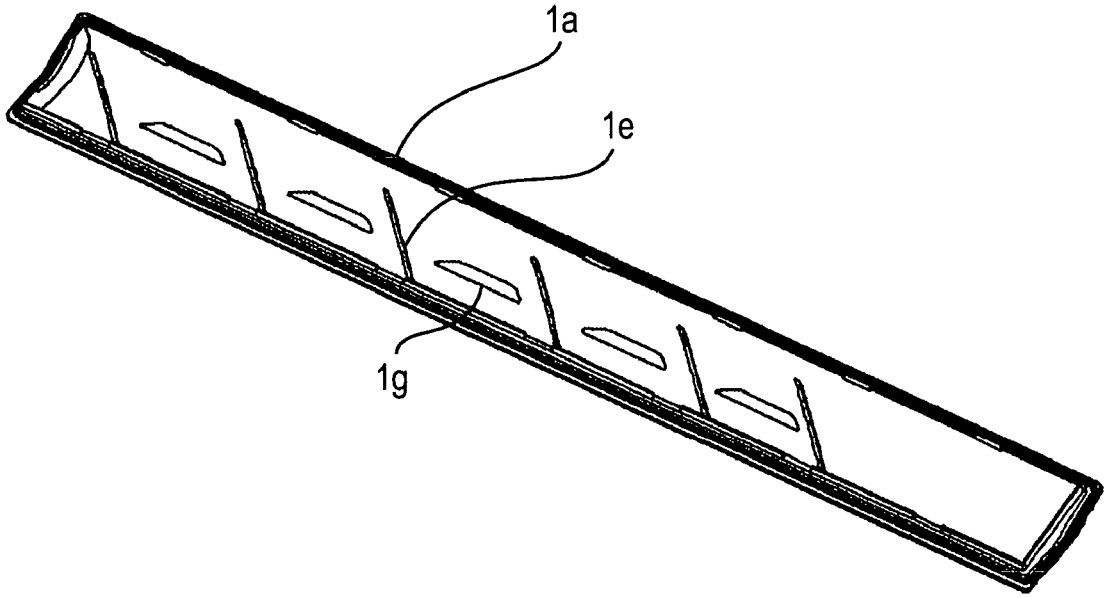

FIG. 8 is an internal perspective view of the upper member of the developer container.

Figure 9:
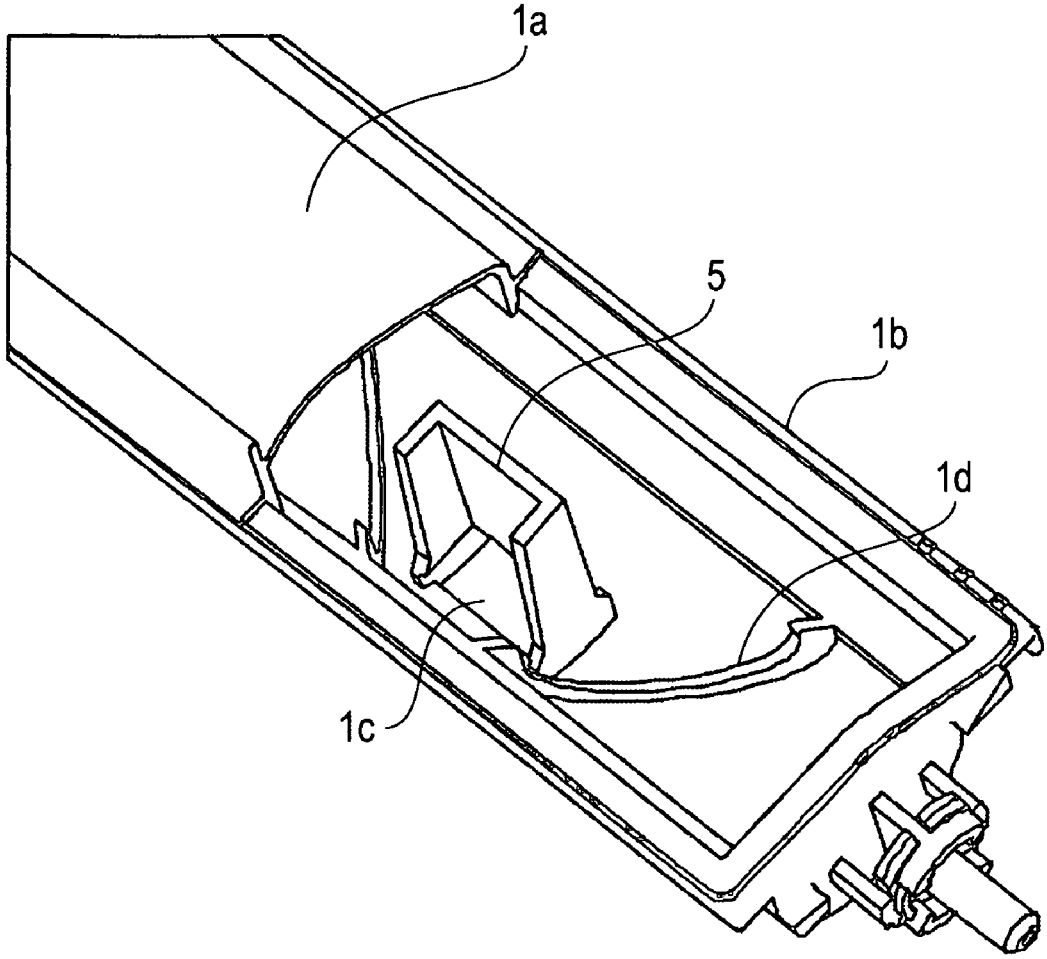

FIG. 9 is a partially exploded perspective view showing a powder pressure suppression member and its vicinity.

Figure 10:
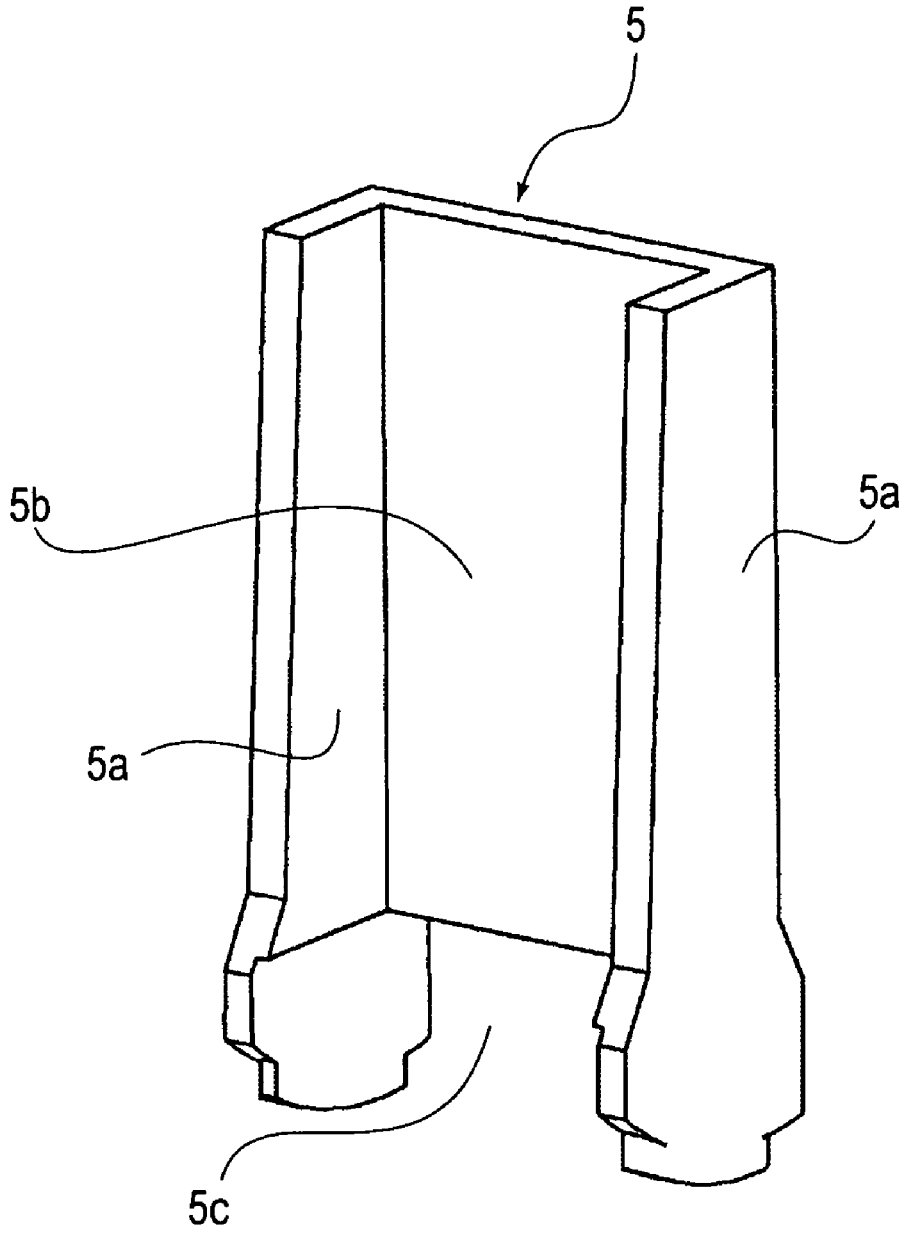

FIG. 10 is an enlarged perspective view of the powder pressure suppression member.

Figure 11:
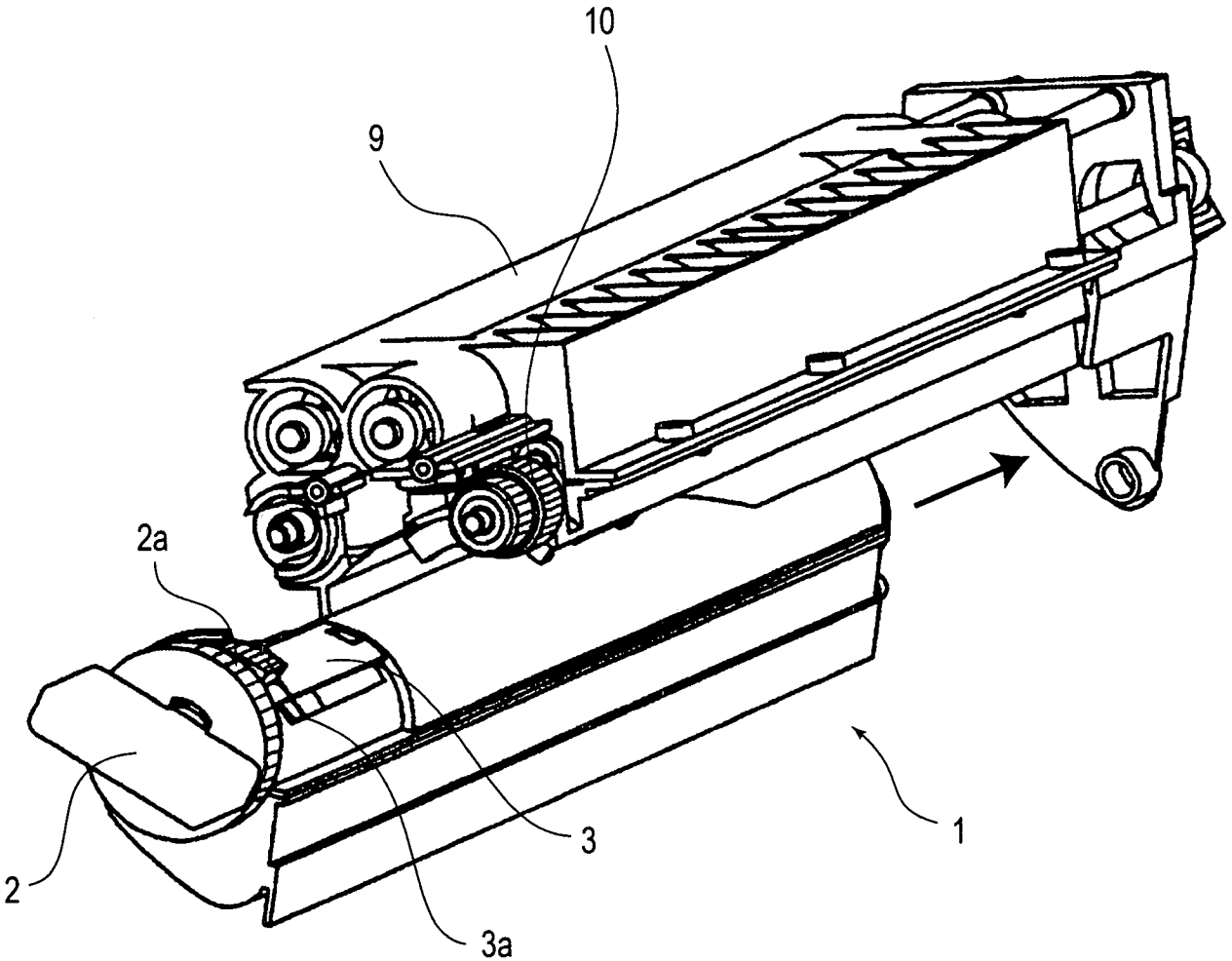

FIG. 11 is a perspective view for illustrating a mounting operation of the developer container.

Figure 12:
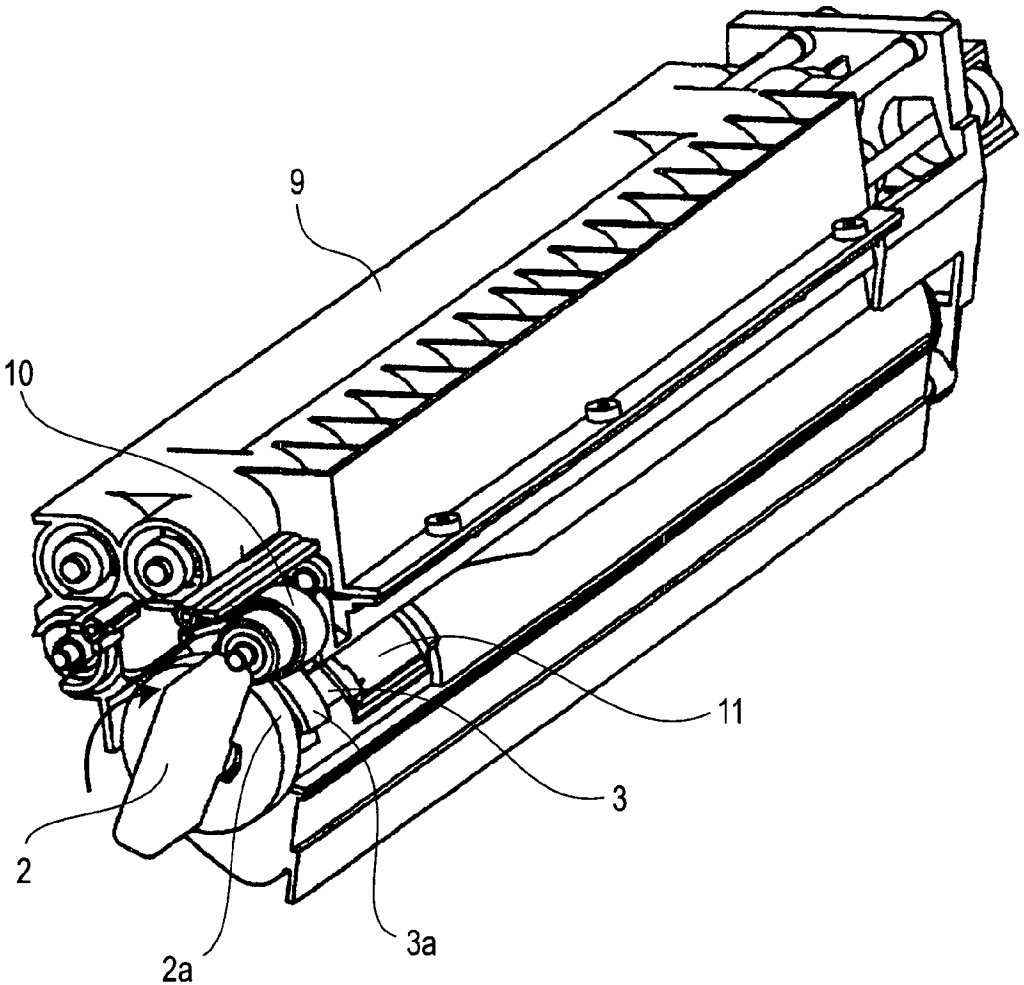

FIG. 12 is a perspective view for illustrating an opening operation of a shutter.

Figure 13:
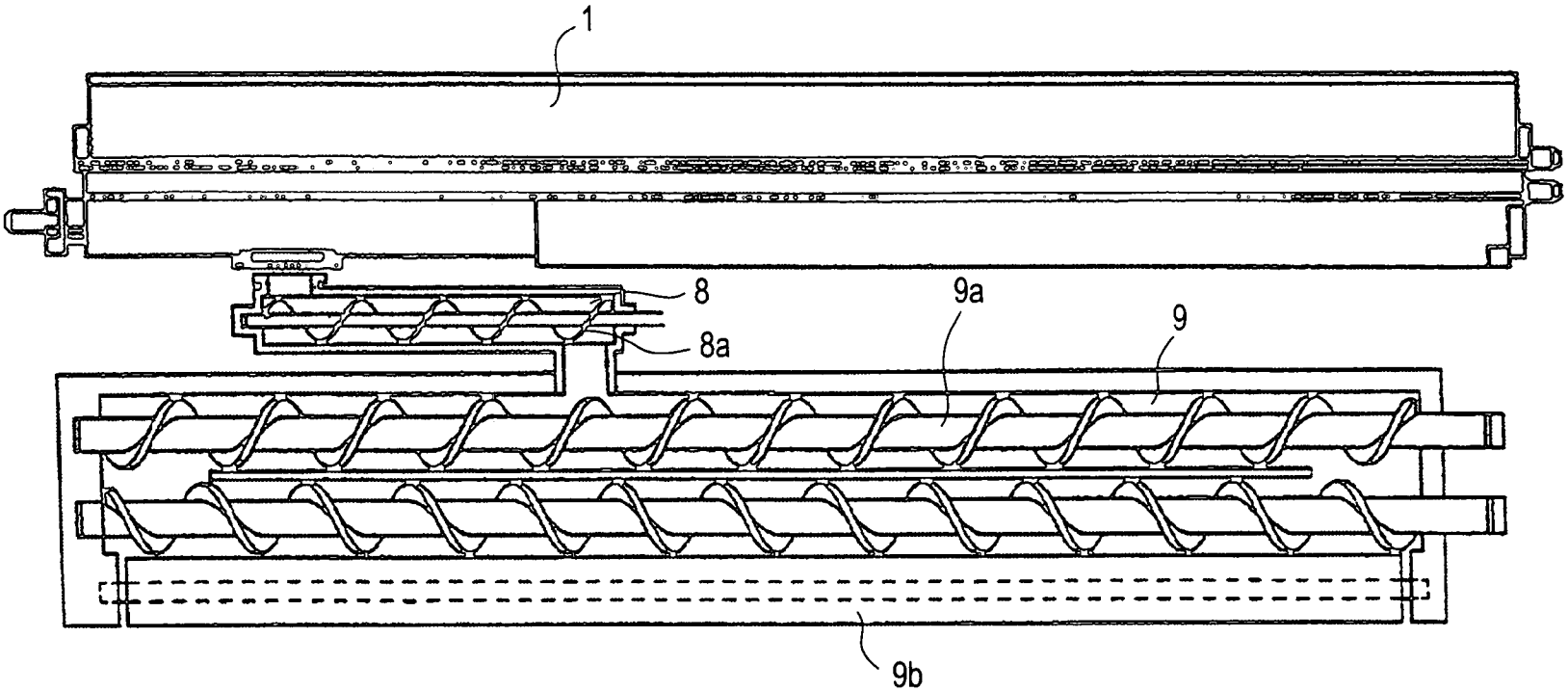

FIG. 13 is a sectional view of a developing device.

Figure 14:
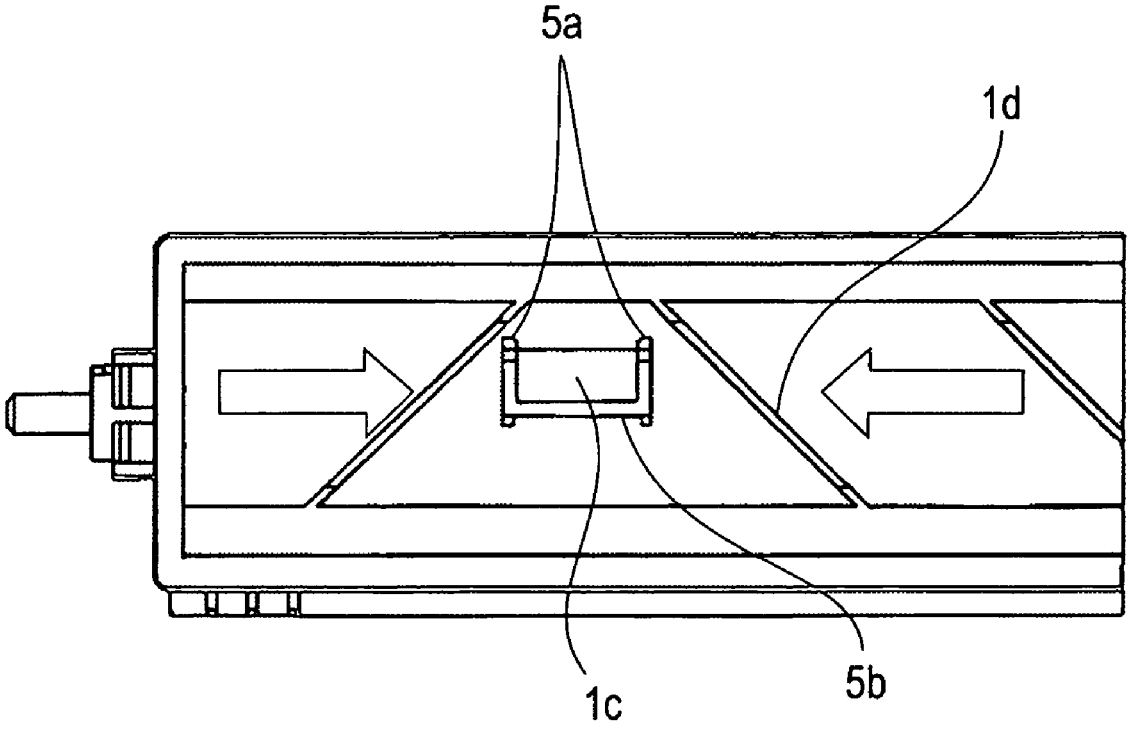

FIG. 14 is a plan view showing a powder pressure suppression member of the lower member and its vicinity.

Figure 15:
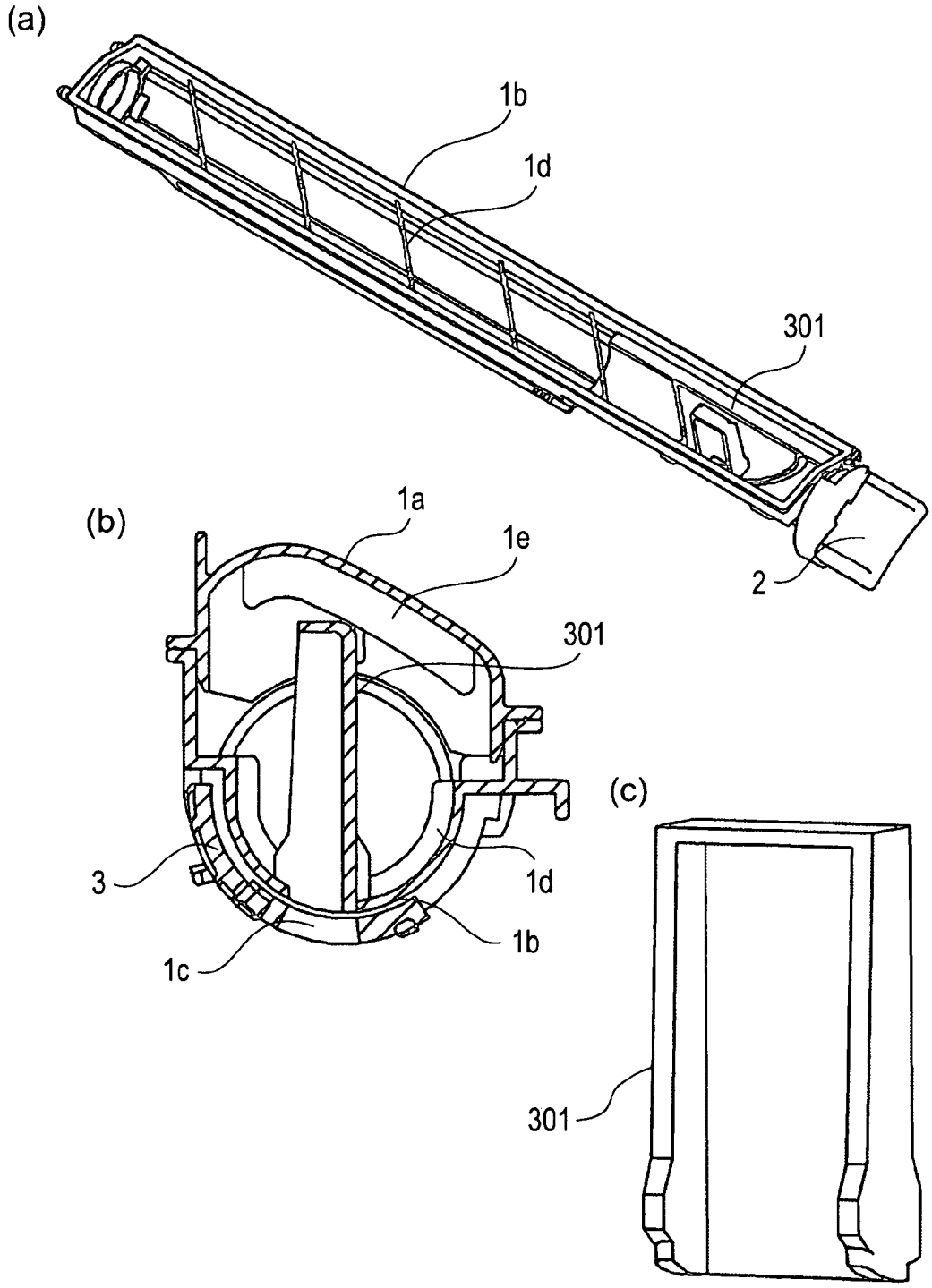

FIGS. 15(*a*), 15(*b*) and 15(*c*) are views showing structural members of a developer container according to Comparative Embodiment 1.

Figure 16:
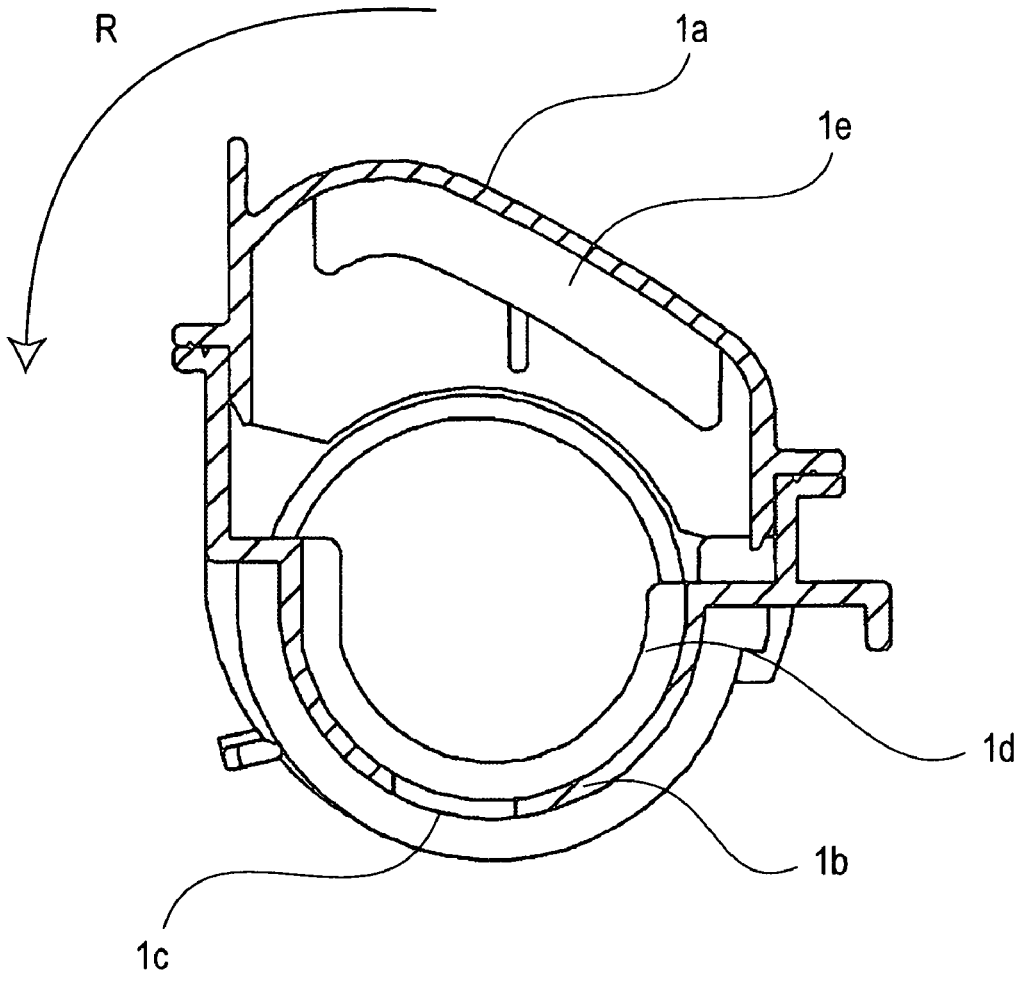

FIG. 16 is a cross-sectional view of a developer container according to Comparative Embodiment 2 at a central portion of a discharge opening of the developer container.

Figure 17:
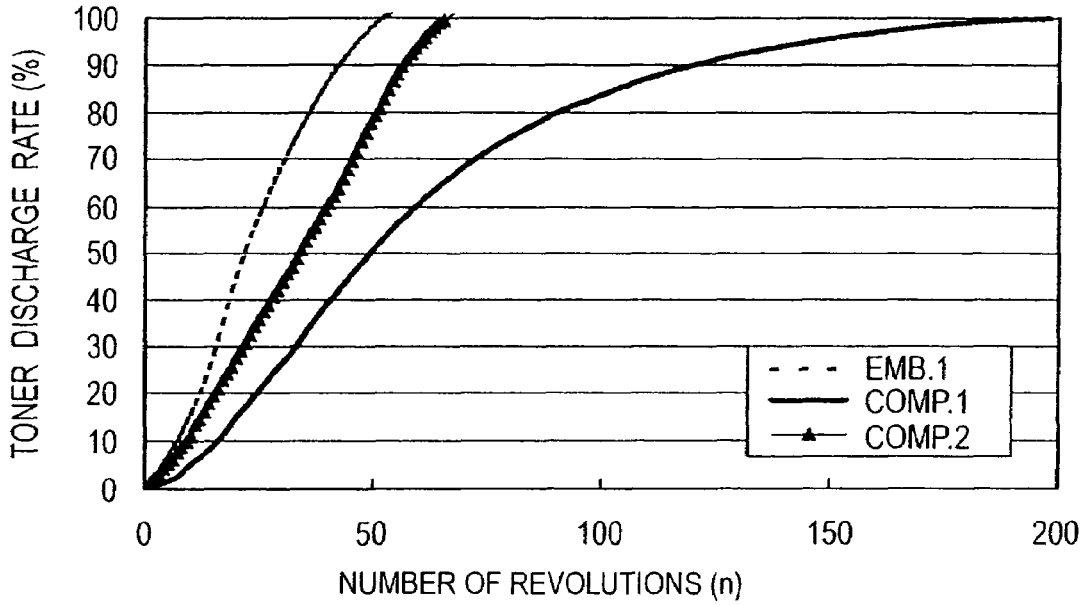

FIG. 17 is a graph showing a relationship between the number of revolution and a toner discharge rate in Embodiment 1 and Comparative Embodiments 1 and 2.

Figure 18:
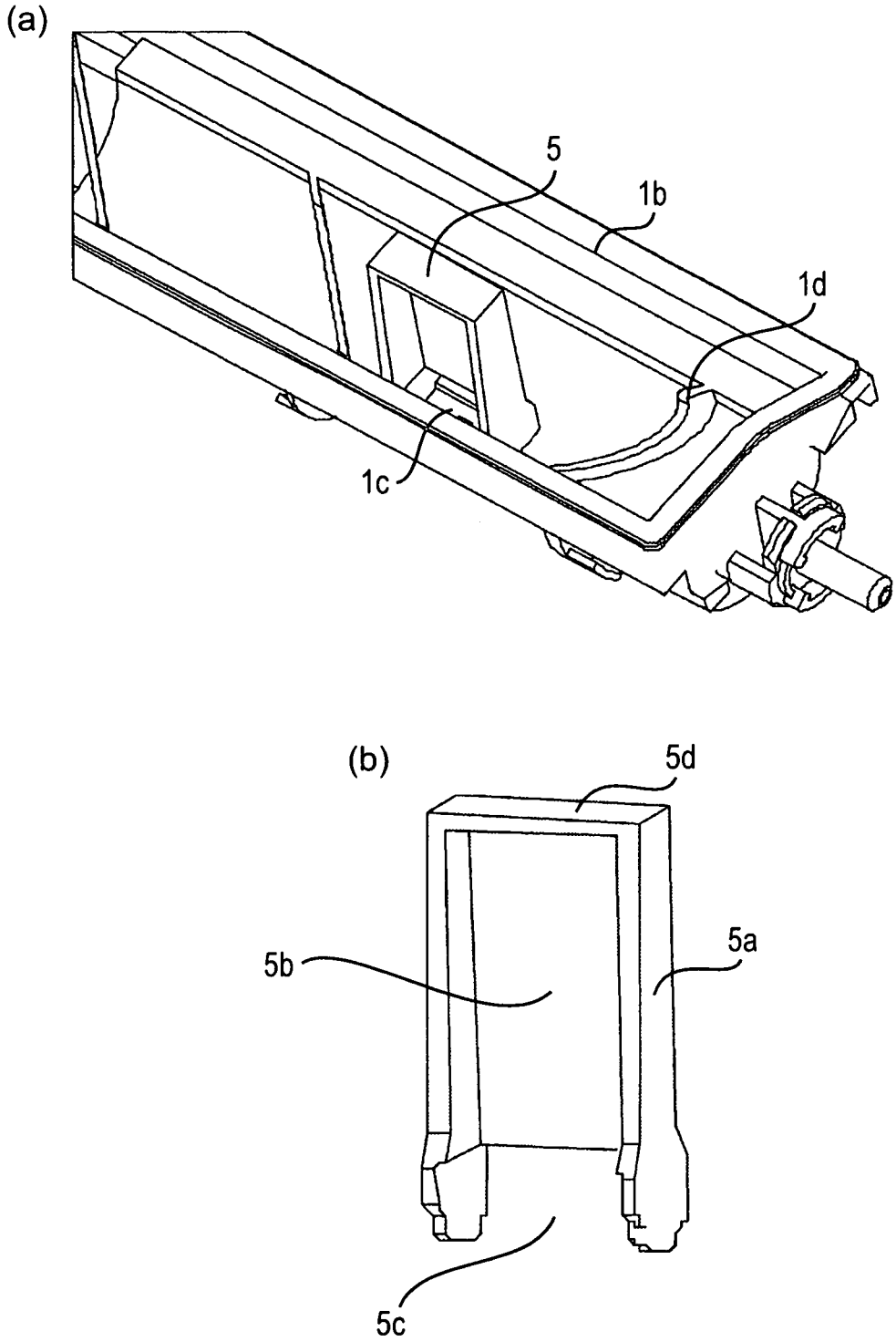

FIGS. 18(*a*) and 18(*b*) are views for illustrating a developer container according to Embodiment 2.

Figure 19:
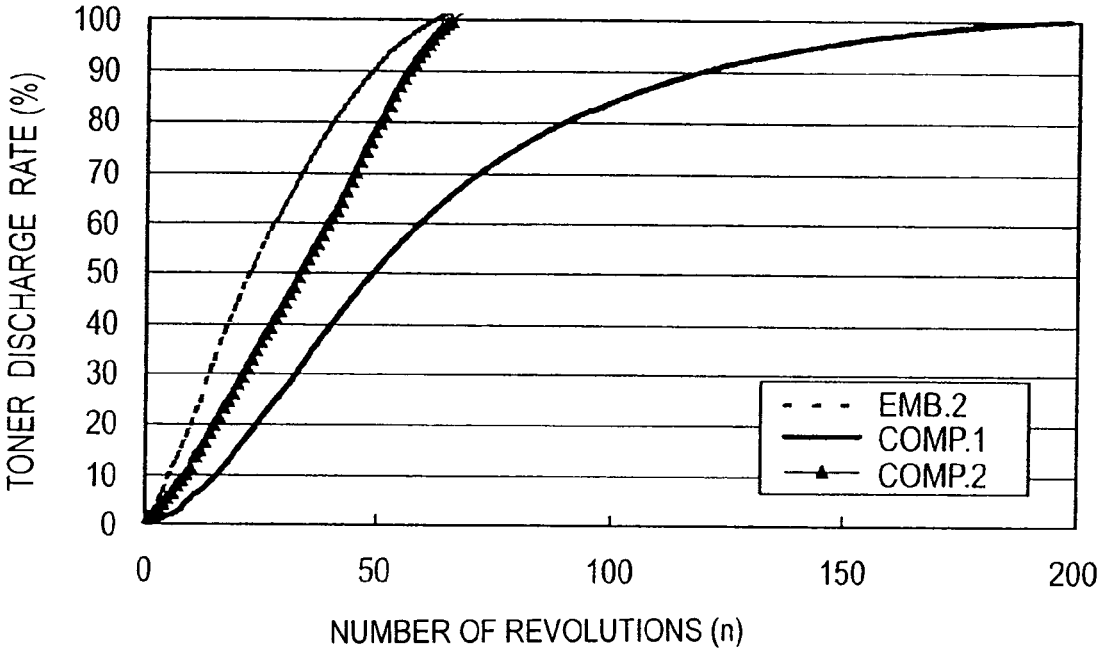

FIG. 19 is a graph showing a relationship between the number of revolution and a toner discharge rate in Embodiment 2 and Comparative Embodiments 1 and 2.

Figure 20:
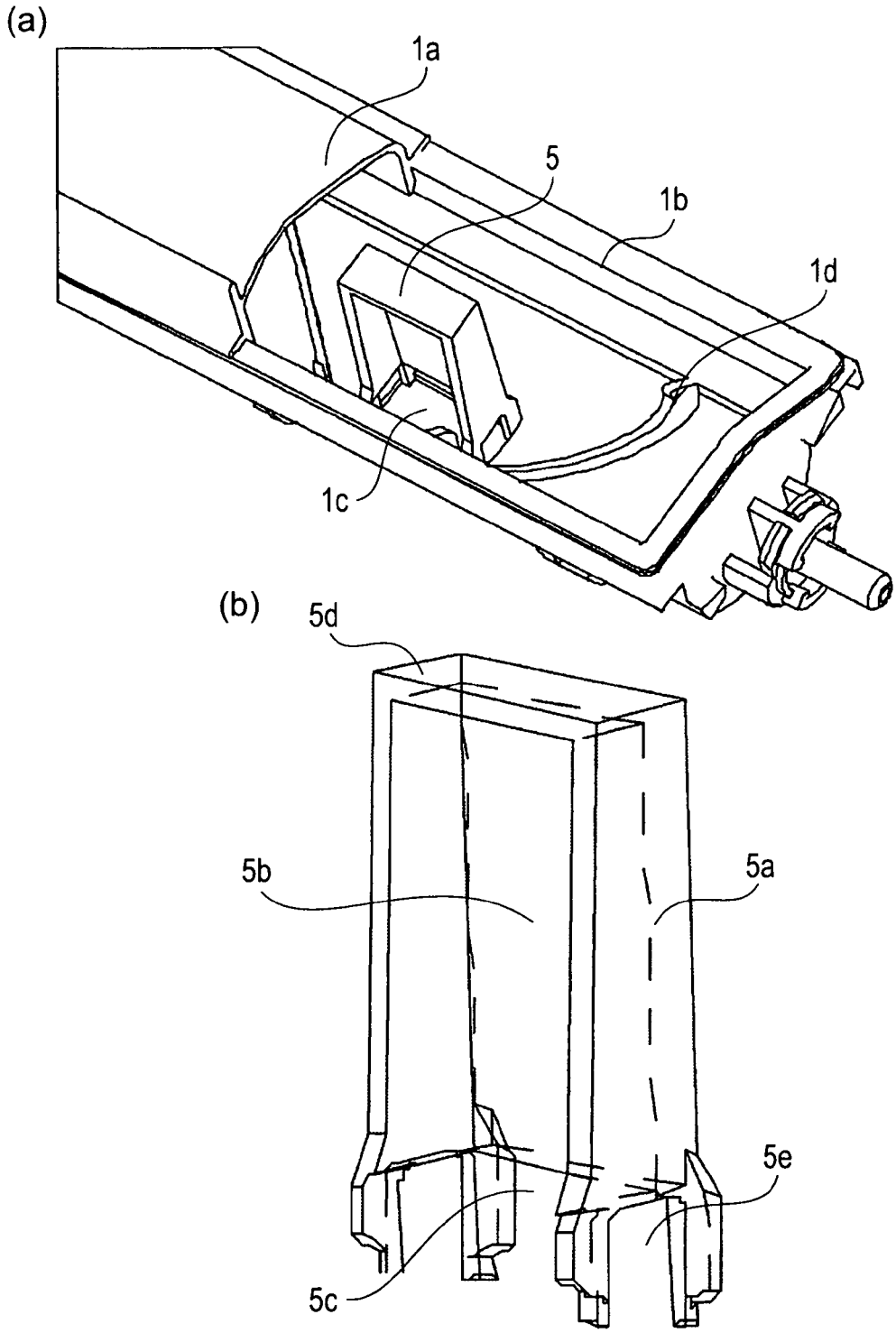

FIGS. 20(*a*) and 20(*b*) are views for illustrating a developer container according to Embodiment 3.

Figure 21:
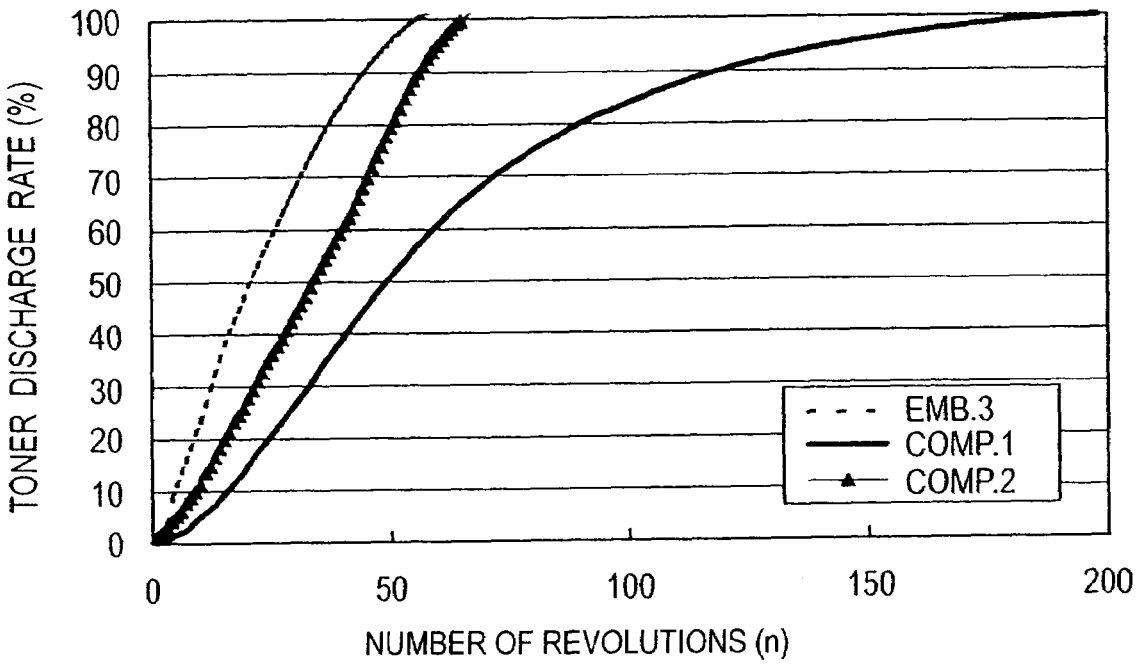

FIG. 21 is a graph showing a relationship between the number of revolution and a toner discharge rate in Embodiment 3 and Comparative Embodiments 1 and 2.

FIG. 22 is a table showing structural members and discharge performance data in Embodiments 1, 2 and 3 and Comparative Embodiments 1 and 2.

Figure 23:
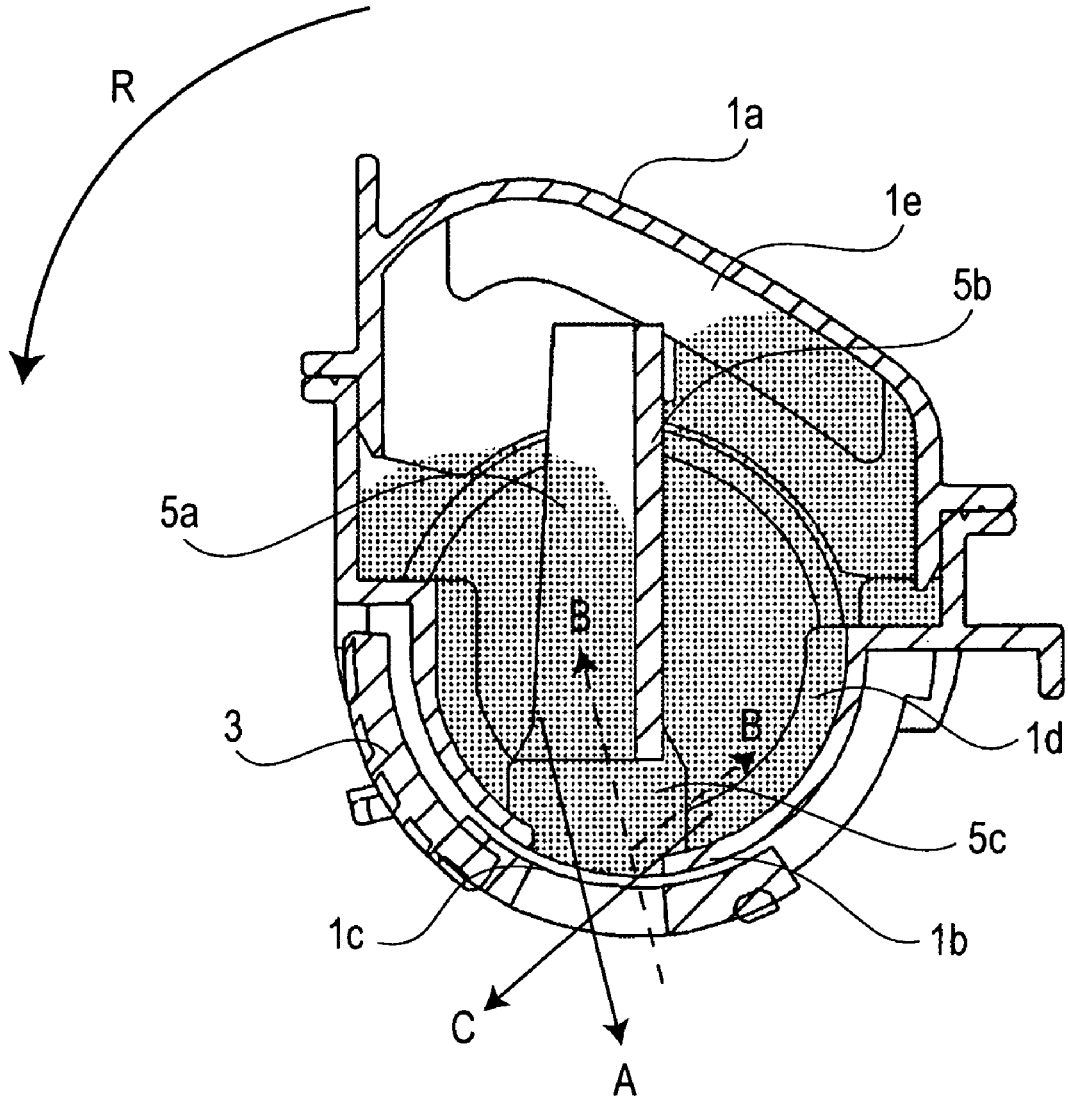

FIG. 23 is a view for illustrating movement of toner.

Figure 24:
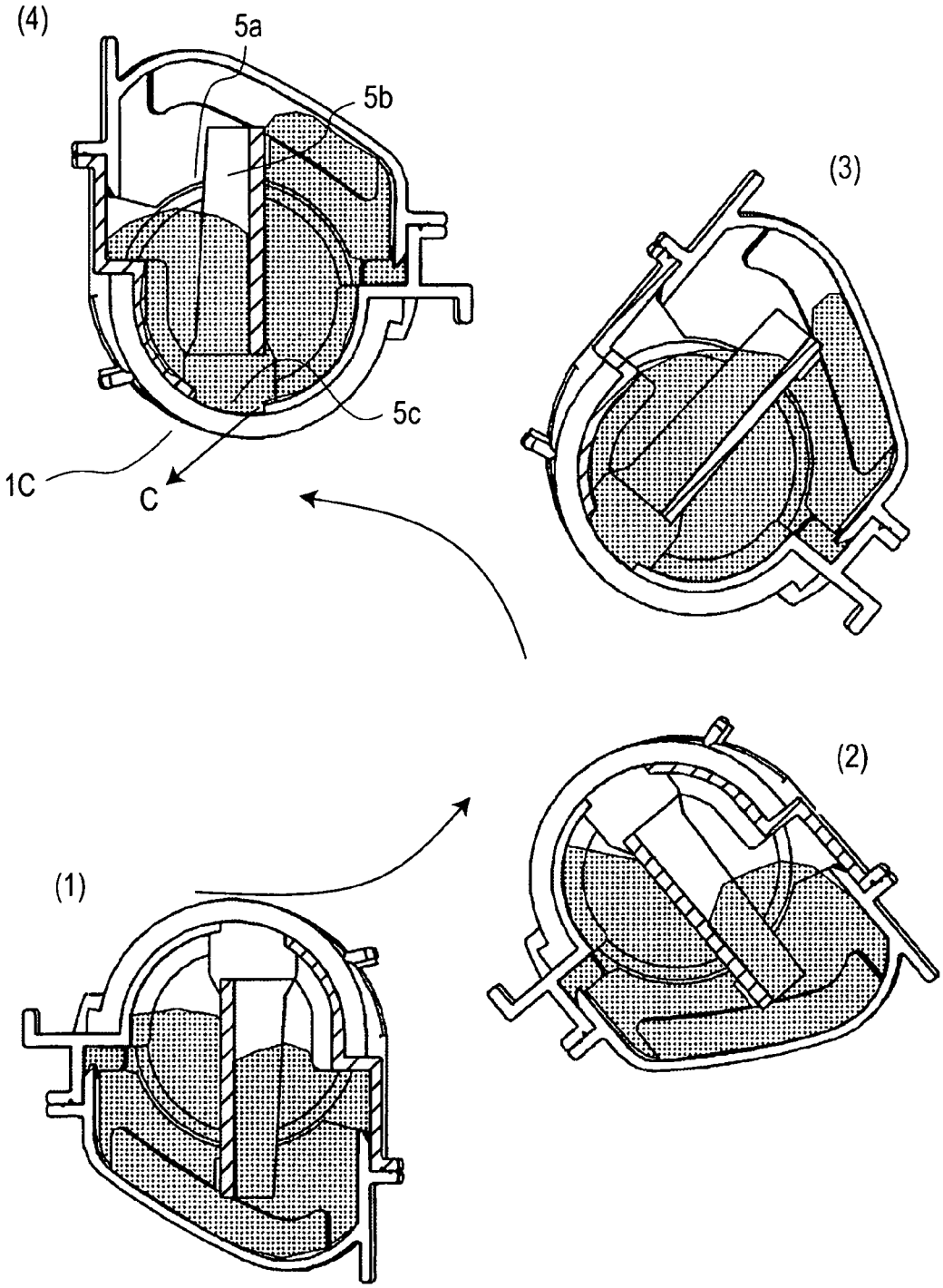

FIG. 24 is a view for illustrating a state of revolution of the developer container.

Figure 25:
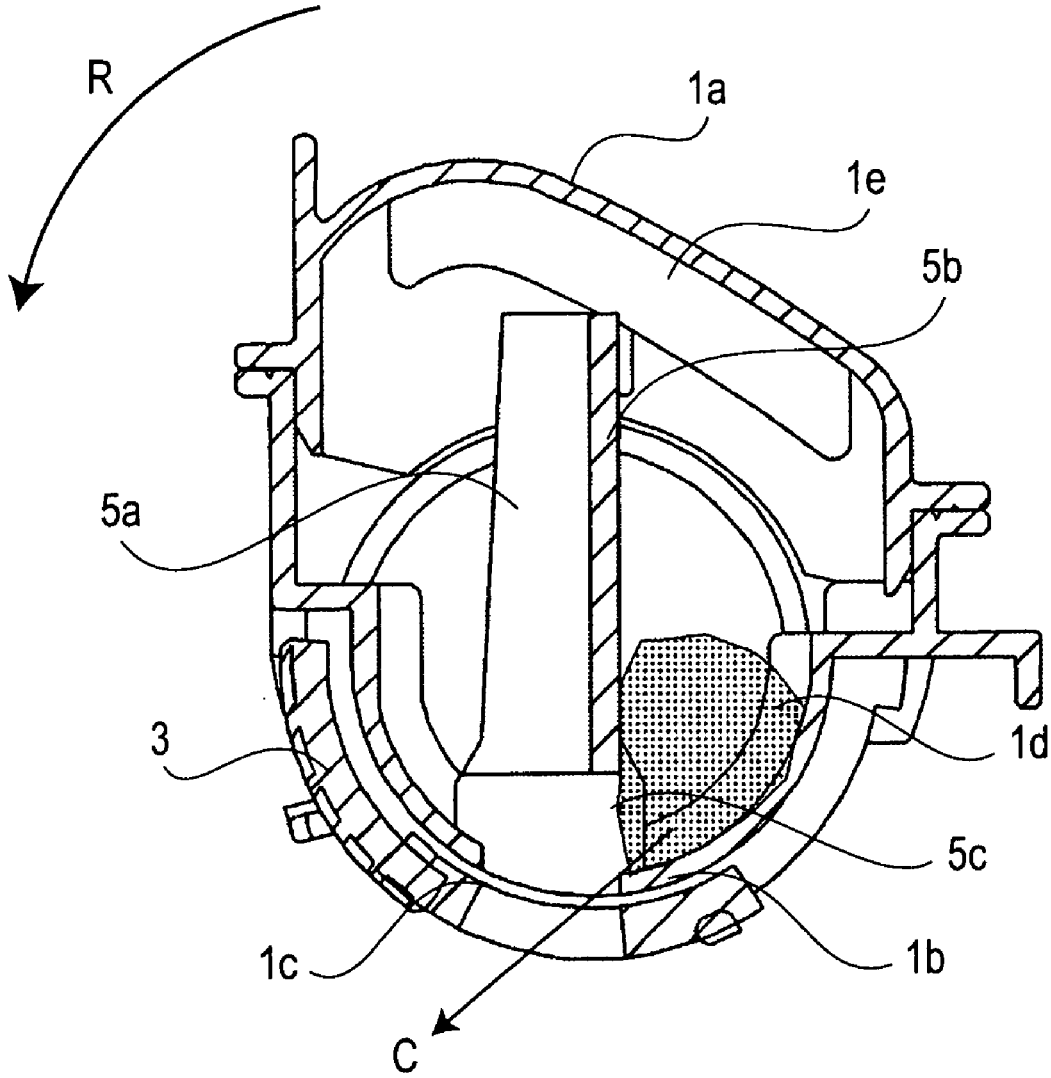

FIG. 25 is a view for illustrating a state of developer at a late stage of discharge.

Figure 26:
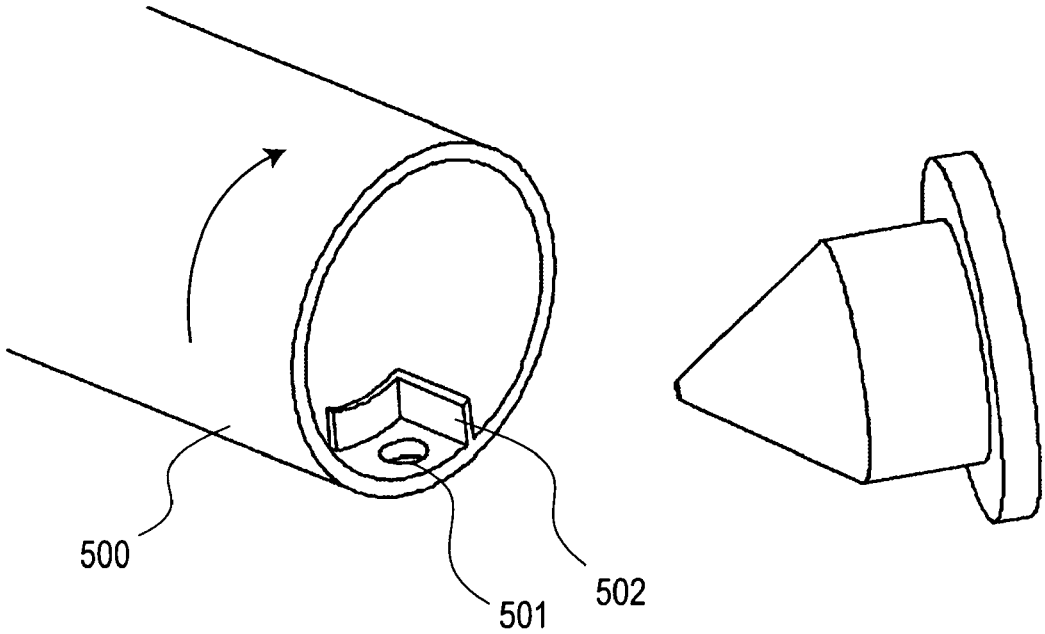

FIG. 26 is a view for illustrating a conventional developer container.

DETAILED DESCRIPTION OF THE PREFERRED EMBODIMENTS

Hereinbelow, the present invention will be described specifically with reference to the drawings.

[Embodiment 1]

Figure 1:
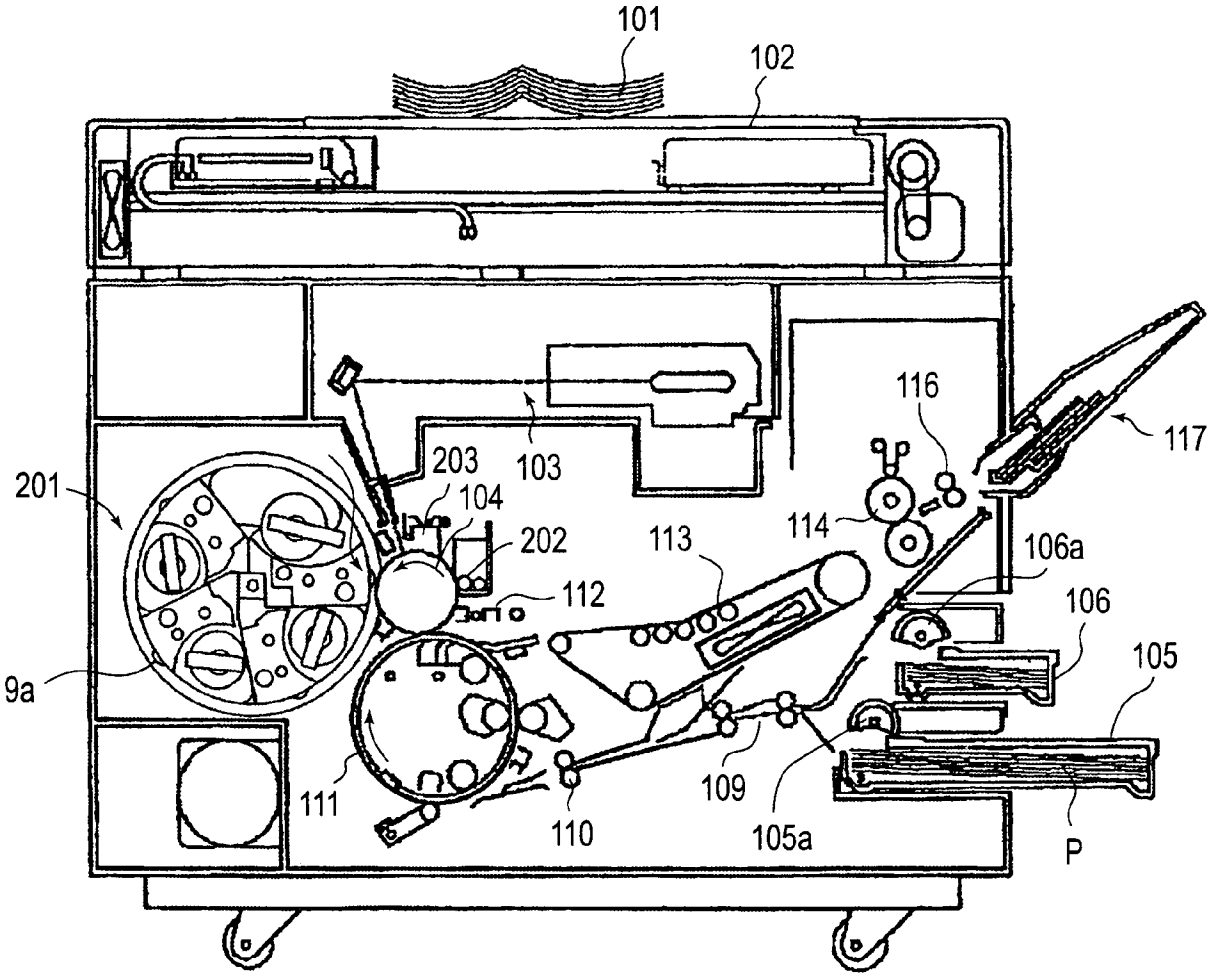
FIG. 1 is a schematic sectional view of an image forming apparatus, to which the developer container according to the present invention is applicable, used in Embodiment 1 appearing hereinafter.

FIG. 1 is a schematic sectional view of an image forming apparatus including a developer container according to this embodiment.

In this embodiment, the developer container is used in an electrophotographic copying machine, as the image forming apparatus, capable of forming a monochromatic image and a full-color image but may also be applicable to other electrophotographic image forming apparatuses, for forming an image on a recording medium according to an electrophotographic image forming method, such as another electrophotographic copying machine, electrophotographic printers (e.g., a laser beam printer, an LED printer, etc.), a facsimile apparatus, and a word processor.

(General Structure)

First of all, a general structure and an operation of the image forming apparatus will be described.

An original 101 is placed on a document glass 102 by an operator. By a plurality of mirrors and lenses of an optical means 103, an optical image of the original is formed on a photosensitive drum 104. On the other hand, a size of a sheet P (such as paper or an OHP sheet), as a recording medium, stacked in paper supply cassettes 105 and 106 in choose on the basis of information inputted by the operator through an operation means (not shown). Then, a feeding roller 105*a* or 106*a* corresponding to the chosen paper supply cassette 105 or 106 is rotated, and a single sheet P fed from the paper supply cassette 105 or 106 is conveyed to registration rollers 110 through a conveying means 109.

The registration rollers 110 convey the sheet P to the photosensitive drum 104 rotated in synchronism with scanning timing of the optical means 103. Onto the sheet P, a toner image on the photosensitive drum 104 is transferred by a transfer means 111. Thereafter, the sheet P is separated from the photosensitive drum 104 by a separation means 112. The sheet P is conveyed to a fixing means 114 by a conveying means 113. The toner image is fixed on the sheet P by the fixing means 114 under application of heat and pressure. Then, the sheet P is discharged onto a tray 117 by discharge rollers 116.

Around the photosensitive drums 104, a rotary developing apparatus 201, a cleaning means 202 and a primary charging means 203 are disposed. The rotary developing apparatus 201 develops an electrostatic latent image formed on the photosensitive drum 104 with toner. The primary charging means 203 electrically charges the photosensitive drum 104. The cleaning means 202 removes the toner remaining on the surface of the photosensitive drum 104. The developer which is decreased in amount by the development is successively supplied from a developer container.

(Rotary Developing Apparatus)

Figure 2:
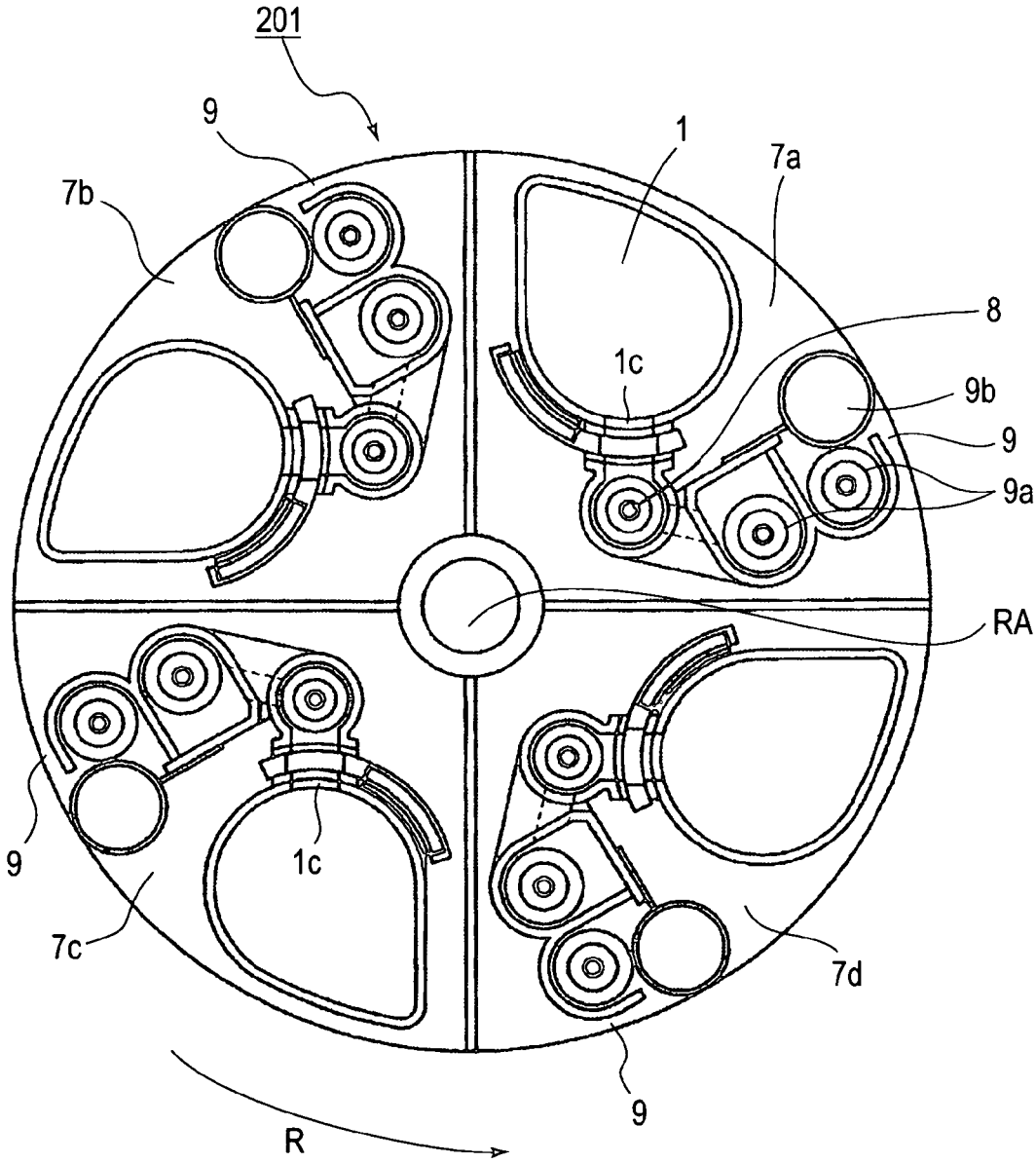
FIG. 2 is a view for illustrating a structure of a rotary developing apparatus.

FIG. 2 is a sectional view for explaining a structure of the rotary developing apparatus 201.

As shown in FIG. 2, the rotary developing apparatus 201 has a substantially cylindrical shape and such an internal structure that it is divided into four sections provided with four developing apparatuses of black (Bk), yellow (Y), magenta (M) and cyan (C), respectively. Each of the developing apparatus includes a developing device 9 and a developer container 1 corresponding thereto. The developer container 1 is used for supplying toner and is detachably mounted in the developing apparatus.

The rotary developing apparatus 201 of this type is rotated 90 degrees at a time counterclockwise about a rotation (revolution) axis RA (in a direction of an arrow R) so that the developing device 9 located opposite to the photosensitive drum 104 is changed. In this embodiment, the developing device 9 is located opposite to the photosensitive drum 104 at a position 7*a*, which is herein referred to as a developing station. A developer conveyance member 9*a* and a developing sleeve 9*b* of the developing device 9 and a developer conveyance member 8*b* of a developer receiving means 8 receives a driving force from a main assembly of the image forming apparatus only at the developing station 7*a*, thus being rotated about the rotation axis RA. At this time, other developing devices 9 and other developer receiving means 8 located at positions 7*b*, 7*c* and 7*d* other than the developing station 7*a* are not actuated.

The developing sleeve 9*b* of the developing device 9 is disposed to have a minute spacing (about 300 $\mu$m) with the photosensitive drum 104. During the development, a thin toner layer is formed on a peripheral surface of the developing sleeve 9*b* by a developing blade (not shown). By applying a developing bias voltage to the developing sleeve 9*b*, an electrostatic latent image formed on the photosensitive drum 104 is developed.

The rotary developing apparatus in this embodiment is rotated, 90 degrees at a time, when image formation on two A4-sized sheets or one A3-sized sheet is performed, whereby the developing device is rotationally moved and changed in position. A movement time for the position change is about 0.3 sec, a stopping time for image formation is about 1.2 sec, a peripheral speed during the movement is about 0.7 m/sec, and a diameter of the rotary developing apparatus is 190 mm.

The diameter of the rotary developing apparatus means a maximum diameter of the rotary developing apparatus 201 placed in such a state that the developer containers 1 are mounted to the rotary developing apparatus 201. Further, in the present invention, a maximum radius (length) from the rotation center of the rotary developing apparatus 201 in such a state that the developer containers 1 are mounted to the rotary developing apparatus 201 is defined as a revolution radius of the developer container 1 and a speed at the maximum radius position is defined as a peripheral speed.

The rotary developing apparatus 201 in this embodiment is equally divided into four sections provided with four developing devices 9 of Bk, Y, M and C and corresponding four developer containers 1, respectively, as described above.

However, the four sections may also be provided by, e.g., unequally dividing the rotary developing apparatus into a Bk developing device having a large volume for supplying a larger amount of black developer which is frequently used, and other three Y, M and C developing devices. By using such a rotary developing apparatus having four sections different in occupied volume, it is also possible to achieve the effect of the present invention.

The developer used in this embodiment may be a monocomponent developer, a two-component toner, a two-component carrier, or a mixture of the two-component toner and the two-component carrier.

(Structure of Developer Supply Container)

Next, the structure of the developer container according to this embodiment will be described.

<General Structure of Developer Container>

FIGS. 3 and 4 are perspective views of the developer container in this embodiment, and FIG. 5 is a cross-sectional view of the developer container at a central portion of a discharge opening.

The developer container shown in these Figures includes a container body 1, a rotation member 2 (hereinafter, referred to as a "knob"), a shutter 3, a packing member 4, and a powder pressure suppression member (as shown in FIG. 9).

The container body 1 has a hollow cylindrical shape as shown in FIGS. 3 and 4 and a noncircular cross section as shown in FIG. 5. By providing the container body 1 with the noncircular cross section, it becomes possible to effectively utilize a restricted space in the rotary developing apparatus. As a result, in each space having the same shape in the rotary developing apparatus, it is possible to increase a filling amount of developer in the developer container.

On the peripheral surface of the container body 1 at one end portion thereof in an axial direction, a discharge opening 1*c* is provided. The discharge opening 1*c* is hermetically closed in an openable and closable manner by the shutter 3 and the packing member 4. The container body 1 can be provided through a method wherein a plastic material is subjected to injection molding, blow molding, injection blow molding, etc. In this embodiment, the container body 1 is prepared by molding and producing separately an upper member 1*a* and a lower member 1*b* with a high-impact polystyrene material and subjecting the upper and lower members 1*a* and 1*b* to ultrasonic fusion, but may be prepared by using another material and/or another method.

The discharge opening 1*c* has a rectangular shape (8 mm×15 mm) and is disposed at a position of 40 mm distant from a container end at the container peripheral surface. The developer contained in the container body 1 is discharged from the discharge opening 1*c* to the developing device on the apparatus main assembly side. By providing the discharge opening 1*c* at the peripheral surface of the container body 1, compared with a developer container provided with a discharge opening at its end surface, it becomes possible to reduce an amount of developer remaining in the developer container after the discharge operation. Further, by shortening a length of the discharge opening 1*c* compared with the full length of the container body 1 in its longitudinal (lengthwise) direction, contamination due to deposition of developer can be alleviated.

The knob (rotation member) 2 comprises a handle portion and a bi-cylindrical portion and is provided with a knob gear at an outer peripheral surface of an outer cylindrical portion and a claw, at an inner peripheral surface of an inner cylindrical portion, for being engaged with a circular projection provided to a side end portion of the container body 1 at its front side end portion by the claw so that it can be reciprocated in a circumferential direction of the container body 1. In this embodiment, the knob 2 is also produced by injection molding of the high-impact polystyrene material but may also be produced by using another material and/or another method. A material having a rigidity which is not less than a certain level is suitably used for the shutter 3. In this embodiment, the shutter 3 is produced through injection molding of a high-slidable ABS resin.

The packing member 4 is disposed to surround the discharge opening 1*c* of the container body 1 and is compressed by the container body 1 and the shutter 3 to hermetically close the discharge opening 1*c*. As the packing member 4, known various foams and elastic members can be appropriately be used. In this embodiment, a polyurethane foam is used.

<Feeding Projection>

FIG. 6 is an internal plan view of the upper and lower members of the container body, FIG. 7 is an internal perspective view of the lower member, and FIG. 8 is an internal perspective view of the upper member.

As shown in FIG. 6, feeding projections 1*d* and 1*e* have a plate-like shape which can be indicated by lines when viewed from a release direction of a metal mold during the molding. In this embodiment, each feeding projection has a height of 5 mm and a thickness of 1 mm. At the smaller diameter portion of the container body 1 on the discharge opening 1*c* side, the feeding projection has a height of 2.5 mm. These feeding projections are arranged so that 6 feeding projections 1*e* are disposed on the upper member 1*a* side and 7 feeding projections 1*d* are disposed on the lower member 1*b* side as shown in FIG. 6.

Each of the feeding projections 1*d* and 1*e* is so inclined that it is away from the discharge opening 1*c* toward upstream with respect to the direction of the rotation movement thereof. More specifically, on the drawing (FIG. 6), each of 6 feeding projections 1*d* provided on the right-hand side of the discharge opening 1*c* of the lower member 1*b* is located such that the discharge opening 1*c* is disposed on the left-hand side of each feeding projection 1*d*. Accordingly, each feeding projection 1*d* is of such a shape that its lower (right) end is away from the discharge opening 1*c* and its upper (left) end is close to the discharge opening 1*c*. On the other hand, one feeding projection 1*d* provided on the left-hand side of the discharge opening 1*c* of the lower member 1*b* is located such that the discharge opening 1*c* is disposed on the right-hand side of the feeding projection 1*d*. Accordingly, the feeding projection 1*d* has such a shape that its lower (left) end is away from the discharge opening 1*c* and its upper (right) end is close to the discharge opening 1*c*.

Further, the feeding projections 1*e* provided to the upper member 1*a* and the feeding projections 1*d* provided to the lower member 1*b* have such a positional relationship therebetween that they are alternately disposed as shown in FIG. 6 in the longitudinal direction of the container body. Further, adjacent feeding projections 1*d* and 1*e* overlap each other in a rotation axis direction by X indicated in FIG. 6. More specifically, respective adjacent two feeding projections overlap each other by X which is set to about 5 mm as a projected length in the rotation axis direction. For this reason, developer fed by the feeding projection 1*e* of the upper member 1*a* is carried to the feeding projection 1*d* of the lower member 1*b* with reliability and then is carried to a subsequent feeding projection 1*e* of the upper member 1*a* with reliability, thus being alternately fed to the feeding projections 1*e* and 1*d* of the upper and lower members 1*a* and 1*b* to be finally fed to the discharge opening 1*c*. As a result, it is possible to prevent escaping of developer from a portion of difference in level between adjacent feeding projections, so that a developer feeding and discharging speed can be improved.

An inclination angle (Y shown in FIG. 6) of the feeding projections 1*d* and 1*e* with respect to the rotation axis direction may preferably be in the range of 20–70 degrees, more preferably 40–50 degrees. In this embodiment, the inclination angle Y is set to 45 degrees. When the inclination angle Y is less than 20 degrees, the developer is less liable to be slipped off along the feeding projection to result in a poor developer feeding performance. On the other hand, when the inclination angle Y is more than 70 degrees, the number of feeding projections is increased to reduce an internal volume of the developer container. Accordingly, by setting the inclination angle Y to be in the above described range, it becomes possible to obtain a good developer feeding performance.

Further, as shown in FIG. 8, in addition to the feeding projections 1*e*, a plurality of plate-like stirring projections 1*g* are provided to the upper member 1*a* so that each stirring projection 1*g* is located between adjacent feeding projections 1*e* in the longitudinal axis direction of the developer container. These plate-like stirring projections 1*g* have such an effect that the toner is stirred during the feeding of developer by the feeding projections 1*e*, thus feeding toner agglomerated in the developer container while loosening the agglomerated toner.

<Powder Pressure Suppression Member>

FIG. 9 is a partially exploded perspective view of a powder pressure suppression member 5 and its vicinity, and FIG. 10 is an enlarged perspective view of the powder pressure suppression member 5.

As shown in FIGS. 9 and 10, the powder pressure suppression member 5 is disposed on an internal surface of the lower member 1*b* in the vicinity of the discharge opening 1*c* and includes side walls 5*a* and a back wall 5*b* provided with a back opening 5*c*. The side walls 5*a* are partially mounted in the discharge opening 1*c* on its inner peripheral surface side, and the back wall 5*b* is disposed upstream of the rotation direction of the developer container while being connected with the side walls 5*a*. The side walls 5*a* and the back wall 5*b* are disposed along the end surfaces of the discharge opening 1*c*. The back wall 5*b* has a function of scooping the toner and a function of preventing concentration of powder pressure on the discharge opening 1*c*, so that it is desirable that it has a length (height), from a scooping surface of the side wall 5*a*, being equal to or more than a length of the discharge opening 1*c* in the lengthwise (longer) direction of the developer container. Each of the side walls 5*a* has a function of preventing escaping of the scooped toner and a function of preventing concentration of powder pressure on the discharge opening 1*c*, so that it is desirable that it has a length (height) which is equal to or more than a length of the discharge opening 1*c* in the shorter direction of the developer container. The back opening 5*c* is located under the back wall 5*b* to be communicated with the discharge opening 1*c*. However, the back opening 5*c* is not necessarily communicated with the discharge opening 1*c* because it is only required to permit substitution of developer with air between it and the discharge opening 1*c* but may desirably be located in the vicinity of the discharge opening 1*c*.

The powder pressure suppression member 5 used in this embodiment is produced through injection molding with a high-impact polystyrene material in an integral molding manner with the container body 1 but may be produced by using another material and/or another method. By performing the integral molding, it is possible to prepare the powder pressure suppression member 5 inexpensively.

<Mounting of Developer Container in Image Forming Apparatus>

Next, such a state that the developer container is mounted in the image forming apparatus and used will be described. FIG. 11 is a perspective view for explaining a mounting operation, and FIG. 11 is a perspective view for explaining an opening operation of a shutter.

First of all, the container body 1 of the developer container is inserted into the developing device 9 of the rotary developing apparatus 201 of the image forming apparatus main assembly with the knob 2 (on the developer discharge opening side) directed toward an operator. In conjunction with the mounting of the developer container, an engagement between a known gear 2*a* and a developing device-side gear 10 and an engagement between the developing device-side gear 10 and a shutter gear 3*a* are ensured and the shutter 3 is engaged in a developing device-side shutter 11 (as shown in FIG. 12).

Then, when the knob 2 is rotated a predetermined angle in a direction of an indicated arrow, a rotational force is transmitted from the known gear 2*a* to the gear 3*a* of the shutter 3 through the developing device-side gear 10, thus rotating the shutter 3. Together with the shutter 3, the developing device-side shutter is also rotated, whereby a hole provided on the developing device shutter side is communicated with the discharge opening 1*c* on the developer container side, thus ensuring a discharge opening portion. A mounting position or method of the developer container in the image forming apparatus is not restricted to that described above but may appropriately be selected depending on a structure of the main assembly of the image forming apparatus.

The developer container is mounted in the rotary developing apparatus in such a manner that it is not rotated on its own axis, and revolves and moves around the rotation axis of the rotary developing apparatus by utilizing the rotation of the rotary developing apparatus. Accordingly, it becomes possible to eliminate a rotational moving force-receiving means from the developer container. As a result, it is possible to realize cost reduction with respect to the developer container and the main assembly of the image forming apparatus.

Mounting and demounting of the developer container may be performed at any position of four stations 7*a* to 7*d* shown in FIG. 2 but may preferably be performed at the stations 7*b*, 7*c* and 7*d* other than the developing station 7*a*. It is particularly preferable that the mounting/demounting operation is performed at the position (station) 7*c* where the associated discharge opening 1*c* is located upward. In this embodiment, the mounting/demounting operation of the developer container is effected at the position 7*c*.

<Operation State>

A state during an operation of the developer container 1 in this embodiment in the rotary developing apparatus 201 will be described. FIG. 13 is a sectional view of the developing device 9 and FIG. 14 is a plan view showing the powder pressure suppression member of the lower member and its vicinity.

As shown in FIG. 13, a predetermined amount of the developer is filled in the developer container 1, and the developer container 1 is mounted in the rotary developing apparatus and is opened at the discharge opening in accordance with the above described procedure. During the image forming process, the developer contained in the developing device 9 is gradually consumed. However, an amount of developer or a ratio between developer and a carrier in the developing device 9 is substantially kept constant because the developer is supplied into the developing device 9 by rotating a developer feeding member 8*a* of a developer-receiving portion 8 for a predetermined time on the basis of a signal from a means for detecting the developer amount or the ratio between the developer and the carrier in the developing device 9. Thereafter, the developer in the developer-receiving portion 8 is decreased particularly at a position, of the developer feeding member 8*a*, located upstream in the feeding direction, i.e., in the vicinity of a portion connected with the discharge opening 1*c* of the developer container 1.

The developer container 1 is disposed immediately above the developer-receiving portion 8. For this reason, when the developer in the developer-receiving portion 8 is decreased, developer present at the end portion of the developer container 1 falls immediately under its own weight to be supplied in the developer-receiving portion 8.

As described above, the developer container 1 disposed in association with the developing device 9 located at a stopping position (developing station 7*a*) where development is performed by the developing device 9 effectively supplies developer in the developing device 9 located at the developing position where developer is consumed because the discharge opening 1*c* is substantially directed toward a gravity direction to permit discharge of developer therefrom by free fall.

In the case where a sufficient amount of developer is not present at the end portion of the developer container 1, the developer contained in the developer container 1 is fed to the end portion by the action of the feeding projections 1*d* and 1*d* during one rotation of the rotary developing apparatus 201. As a result, the developer is supplied in the developer-receiving portion 8 during a period in which the associated developing device 9 is returned again to the developing station 7*a*.

The position of the discharge opening 1*c* of the developer container 1 in the developing station 7*a* may be any position but may preferably be obliquely above the rotation axis of the rotary developing apparatus, particularly immediately above the developer-receiving portion 8. Even when the developing device 9 is so disposed that the developer cannot be supplied from the developer container 1 into the developer-receiving portion 8 by fee fall in the developing station 7*a*, the developer container 1 can be located above the developer-receiving portion 8*a* always during one rotation of the rotary developing apparatus 201. As a result, the developer can be supplied.

Such a state that the developer in the developer container is discharged by rotation will be described with reference to FIG. 5.

When the developer is supplied in the developing device 9, the developer passes through the discharge opening 1*c* under its own weight. At that time, by the presence of the back wall 5*b* of the powder pressure suppression member 5, toner located downstream in the rotation direction R is passed through the discharge opening 1*c* to be discharged as it is, and toner located upstream in the rotation direction R is passed through the back opening 5*c* while being regulated by the back wall 5*b* and then is passed through the discharge opening 1*c* to be supplied in the developing device 9.

Here, in the case where there is no back wall 5*b*, powder pressure of toner is increased on an inner surface of the discharge opening 1*c*, so that a bulk density of the toner is increased. As a result, a possibility of an occurrence of toner blocking becomes high.

FIG. 14 is a view of the lower member 1*b* when viewed from the above direction of the powder pressure suppression member.

The developer in the developer container 1 is moved in the directions of indicated arrows by revolution of the developer container 1 (around the rotation axis of the rotary developing apparatus) to be fed to the discharge opening 1*c*. At that time, the pressure of developer in the lengthwise direction of the developer container 1 is suppressed by the side walls 5*a* of the powder pressure suppression member 5, so that it is possible to prevent an increase in powder pressure in the vicinity of the discharge opening 1*c*.

The developer in the developer container 1 is substituted with air during the discharge thereof from the discharge opening 1*c*. By taking in air from the outside of the developer container 1, a difference in atmospheric pressure is removed, thus permitting discharge of developer through the discharge opening 1*c*. Air is passed through a spacing between toner particles but is less liable to be passed therethrough when a powder pressure of the toner particles is increased to narrow the spacing. As shown in FIG. 23, the back opening 5*c* is so disposed that the substitution of developer with air through the discharge opening 1*c* (as indicated by an arrow B) is not inhibited. In the case where there is not back opening 5*c*, a resultant powder pressure of toner particles becomes higher on an inner peripheral surface of the developer container 1 in the vicinity of the discharge opening 1*c*. As a result, a bulk density of the toner particles is increased, so that a possibility of an occurrence of toner blocking becomes higher.

The back opening 5*c* further has two functions including a function of permitting discharge of developer located close to the discharge opening 1*c* by inertial force during a stop of initial rotation and a function of causing the toner to pass through it during the latter stage of discharge of toner (i.e., when an amount of toner remaining in the developer container is decreased). With respect to the former function, when the container body 1 is revolved and stopped at a position (4) (at which the discharge opening 1*c* is directed downward) as shown in FIG. 24, the developer is discharged in a direction of an indicated arrow C by the internal force. At that time, toner having a high bulk density is also discharged in the vicinity of the discharge opening 1*c*. As a result, it is possible to prevent initial toner blocking. As for the latter function, a state of developer at the latter discharge stage is shown in FIG. 25. In the case where the rotation (revolution) of the container body is taken into account, the developer is located outside the walls of the powder pressure suppression member 5 when the amount of removing toner is small. In this case, when the back opening 5*c* is not provided, the toner is blocked by three walls of the powder pressure suppression member 5, so that the toner cannot be discharged. Accordingly, the toner cannot be used up.

(Experiment)

In this experiment, discharge performances of a developer container described in JP-B No. 3168722 and the developer container of this embodiment are compared. As described above the developer container of this embodiment has the structure shown in FIG. 5 (cross-sectional view at the central portion of discharge opening), FIG. 7 (lower member 1*b*) and FIG. 8 (upper member 1*a*).

<Comparative Embodiment 1>

A structure of a discharge opening of Comparative Embodiment 1 is shown in FIGS. 15(*a*), 15(*b*) and 15(*c*). FIG. 15(*a*) is an internal perspective view of a lower member, FIG. 15(*b*) is a cross sectional view of the developer container at a discharge opening central portion, and FIG. 15(*c*) is an enlarged perspective view of a powder pressure suppression member. Members and means identical to those described in the above embodiment are indicated by the same reference numerals and explanation therefor will be omitted.

In Comparative Embodiment 1, a powder pressure suppression member provided at a discharge opening 1 corresponds to a measuring member 301 proposed in JP-B No. 3168722.

<Comparative Embodiment 2>

FIG. 16 shows a cross-sectional view of a developer container of Comparative Embodiment 2 at a central portion of the discharge opening thereof.

As shown in FIG. 16, the developer container is not provided with the measuring member and the powder pressure suppression member but only provided with feeding projections.

A comparative experiment was conducted by using the above described three types of developer containers under such a condition that the same feeding performance for feeding the developer to the discharge opening is provided. More specifically, each of the developer containers has 5 mm-high feeding projections including 5 feeding projections provided on the upper member 1*a* side and 5 feeding projections provided on the lower member 1*b* side with an overlapping amount of 5 mm therebetween.

In each of these developer containers, 180 g of developer was filled and subjected to a discharging test by using a simple rotary developer discharging jig (capable of directly measuring an amount of developer discharged from the discharge opening of the developer container by removing the developing devices from the rotary developing apparatus) under conditions including a rotation angle, of the simple rotary developer discharging jig, of 90 degrees at a step (90 degrees×4 for one revolution), a movement time of about 0.3 sec., a stop time for image formation of about 1.2 sec., a peripheral speed during movement of about 0.7 m/sec., and a diameter of 190 mm.

<Results>

Experimental results are shown in FIG. 17 which a graph showing a relationship between the number (n) of revolutions (rotations) and a toner discharge rate (%). Further, structural members and discharge performance data are shown in FIG. 22.

As shown in FIG. 22, with respect to initial 5 revolutions for discharging developer, an average discharge amount was 2.7 g/revolution for Embodiment 1 (with powder pressure suppression member 5), 0.51 g/rev. for Comparative Embodiment 1 (with measuring member 301), and 0.42 g/rev. for Comparative Embodiment 2 (only with feeding projections).

Further, a remarkable difference in discharge state between the developer containers was observed. More specifically, with respect to the developer containers of Comparative Embodiment 1 (with measuring member 301) and Comparative Embodiment 2 (only with feeding projections), the discharge state of developer was such that toner having a high bulk density was not discharged successively but discharged intermittently at an initial discharge state. On the other hand, with respect to the developer container of Embodiment 1, the discharge state of developer was such that toner having a low bulk density was successively discharged.

A remaining amount (rest) of toner was about 1.5 g for the developer container of Embodiment 1, about 2.4 g for the developer container of Comparative Embodiment 1, and about 1.5 g for the developer container of Comparative Embodiment 2.

<Constitution>

From the above results, compared with the comparative developer containers of Comparative Embodiment 1 (with measuring member 301) and Comparative Embodiment 2 (only with feeding projections), the developer container of Embodiment 1 (with powder pressure suppression member 5) provided a higher discharge speed of developer.

The reason therefor will be considered based on the cross-sectional views of developer containers shown in FIG. 5, FIG. 15(*a*) and FIG. 16.

In Comparative Embodiment 1, as shown in FIG. 15(*b*), the developer container including the measuring member 301 is provided with walls (wall members) on an upstream side (back side) thereof in the rotation direction and side portions thereof in the container axis direction on an internal peripheral surface of the container body in the vicinity of discharge opening 1*c*, so that the toner cannot be supplied from these directions. As a result, only the toner located downstream in the rotation direction in the measuring member 301 is discharged through the discharge opening 1*c*, thus resulting in a small supply amount of toner. With respect to the remaining toner amount, in view of the rotation direction of the developer container, the toner remains on the upstream side in the rotation direction due to centrifugal force. The remaining toner is blocked by the walls of the measuring member 301, thus failing to reach the discharge opening 1*c* to be increased in amount.

In the developer container (only with feeding projections) of Comparative Embodiment 2, as described with reference to FIG. 14, the developer is liable to be agglomerated at the discharge opening 1*c* by the feeding projection 1*d*. Further, as is understood from the cross section of the developer container shown in FIG. 16, the powder pressure of toner is liable to be concentrated in the vicinity of the discharge opening 1*c* due to the weight of developer itself. Particularly, at an initial discharge state, toner contained in the developer container is not stirred sufficiently, thus being placed in a high bulk density state. As a result, at the initial discharge state, the toner is decreased in discharge amount, thus being discharged intermittently. Thereafter, when the stirring of developer in the developer container is sufficiently performed, the discharge amount of toner is gradually increased. With respect to the remaining toner amount, the developer container has such a structure that the toner is discharged with reliability in a larger amount than the case of the developer container of Comparative Embodiment 1, thus providing a smaller amount of remaining toner.

On the other hand, in Embodiment 1, as shown in FIGS. 5 and 14, the developer container including the powder pressure suppression member 5 is provided with walls on an upstream side (back side) thereof in the rotation direction and side portions thereof in the container axis direction on an internal peripheral surface of the container body in the vicinity of discharge opening 1*c*, so that the powder pressure of toner is effectively suppressed in these directions. However, the back wall 5*b* of the powder pressure suppression member 5 is provided with a back opening 5*c*, which is a characteristic feature of the present invention, through which the toner is caused to pass while suppressing an increase in bulk density in the powder pressure suppression member 5 by restricting the powder pressure of toner owing to the presence of the back wall 5*b*. As a result, the toner in the powder pressure suppression member 5 is replenished. Accordingly, as shown in FIG. 17, the toner discharge rate is higher even at the smaller number of revolutions from the initial stage.

With respect to the toner replenishing effect, it can be expected that the similar effect is also achieved by providing an opening to the side walls 5*b* in place of the back wall 5*b*. However, particularly with respect to the remaining toner amount, the back opening 5*c* is disposed on the upstream side in the rotation direction, so that the remaining toner can pass through the back opening 5*c* along the inner peripheral surface of the lower member 1*b* to reach the discharge opening 1*c*. For this reason, it is considered that the provision of the back opening 5*c* to the back wall 5*b* is effective for reducing the remaining toner amount.

[Embodiment 2]

FIGS. 18(*a*) and 18(*b*) are perspective views for illustrating a developer container of this embodiment, and FIG. 19 is a graph showing a relationship between the number of revolutions and a toner discharge rate in this embodiment together with Comparative Embodiments 1 and 2. In FIGS. 18(*a*) and 18(*b*), members and means identical to those in Embodiment 1 are represented by the same reference numerals and explanation therefor will be omitted.

In this embodiment, the developer container has the same structure as that in Embodiment 1 except that the shape of the powder pressure suppression member 5 is changed to that shown in FIG. 18(*b*).

More specifically, the powder pressure suppression member 5 is further provided with a top wall 5*d* disposed to cover the upper (top) surfaces of three walls 5*a* and 5*b*. Instead of the top wall 5*d*, it is also possible to so design the upper member 1*a* that a part thereof is disposed to cover the upper surfaces of three walls 5*a* and 5*b*.

As a result of experiment, as shown in FIGS. 19 and 22, an average discharge amount of toner was 2.9 g/rev. with respect to initial 5 revolutions, and the toner was successively discharged without interruption. Further, the remaining toner amount was 1.6 g. According to this embodiment, by providing the top wall 5*d* as described above, it becomes possible to suppress the powder pressure of toner exerted from the above direction. As a result, from the initial stage, it is possible to further smoothly perform the discharge of toner by suppressing an increase in bulk density.

[Embodiment 3]

FIGS. 20(*a*) and 20(*b*) are perspective views for illustrating a developer container of this embodiment, and FIG. 21 is a graph showing a relationship between the number of revolutions and a toner discharge rate in this embodiment together with Comparative Embodiments 1 and 2. In FIGS. 20(*a*) and 20(*b*), members and means identical to those in Embodiment 1 are represented by the same reference numerals and explanation therefor will be omitted.

In this embodiment, the developer container has the same structure as that in Embodiment 1 except that the shape of the powder pressure suppression member 5 is changed to that shown in FIG. 20(*b*).

More specifically, the powder pressure suppression member 5 is further provided with not only a top wall 5*d* disposed similarly as in Embodiment 2 but also side openings 5*e* each provided to an associated side wall 5*a* of the powder pressure suppression member 5. In other words, different from the powder pressure suppression member 5 having only one opening (the back opening 5*c* of the back wall 5*b*) in Embodiment 1, the powder pressure suppression member 5 in this embodiment further has other two openings (side openings 5*e* of the side wall 5*a*).

As a result of experiment, as shown in FIGS. 21 and 22, an average discharge amount of toner was 3.2 g/rev. with respect to initial 5 revolutions, and the toner was successively discharged without interruption. Further, the remaining toner amount was 1.5 g. According to this embodiment, by providing the side openings 5*e* as described above, it is found that the amount of toner passing through the back opening 5*c* of the back wall 5*b* and the side openings 5*e* of the side walls 5*a* is increased, so that the discharged toner amount is also increased. Further, by appropriately changing the sizes of the back opening 5*c* and the side openings 5*e*, it is also possible to change the amount of toner to be discharged.

While the invention has been described with reference to the structures disclosed herein, it is not confined to the details set forth and this application is intended to cover such modifications or changes as may come within the purposes of the improvements or the scope of the following claims.

This application claims priority from Japanese Patent Application No. 307151/2003 filed Aug. 29, 2003 which is hereby incorporated by reference.

What is claimed is:

1. A developer container for feeding and discharging developer by rotationally moving about a rotation axis, the container comprising:

a container body for containing developer and is provided with a discharge opening for permitting discharge of the developer; and developer movement suppression means disposed inside and adjacent to the discharge opening, wherein said developer movement suppression means comprises a first wall member for scooping the developer contained in said container body by rotational movement of said container body and a second wall member, disposed at an end portion of said first wall member with respect to a rotation axis direction for suppressing movement of the developer scooped by said first wall member while permitting the developer to partly move from one side to the other side thereof, and wherein said second wall member is provided with an opening for permitting passage of the developer through said second wall member.

* * * * *

UNITED STATES PATENT AND TRADEMARK OFFICE

CERTIFICATE OF CORRECTION

PATENT NO. : 6,985,686 B2
APPLICATION NO. : 10/924922
DATED : January 10, 2006
INVENTOR(S) : Ayatomo Okino et al.

It is certified that error appears in the above-identified patent and that said Letters Patent is hereby corrected as shown below:

Title page,
Item [56], References Cited, FOREIGN PATENT DOCUMENTS,
"06102758" should read -- 06-102758 --; and
"31688722" should read -- 3-168722 --.

Column 1,
Line 39, "No. 3168722" should read -- No. 3-168722 --;
Line 45, "above described" should read -- above-described --; and
Line 46, "No. 3168722" should read -- No. 3-168722 --.

Column 2,
Line 64, "revolution" should read -- revolutions --.

Column 3,
Lines 2 and 7, "revolution" should read -- revolutions --; and
Line 47, "in choose" should read -- is chosen --.

Column 6,
Line 18, "be" should be deleted.

Column 7,
Line 21, "above described" should read -- above-described --.

Column 8,
Line 59, "is" should read -- be --.

Column 9,
Line 8, "above described" should read -- above-described --; and
Line 55, "fee" should read -- free --.

Column 10,
Line 67, "No. 3168722" should read -- No. 3-168722 --.

Column 11,
Line 10, "cross sectional" should read -- cross-sectional --;
Line 20, "3168722." should read -- 3-168722. --; and
Line 31, "above described" should read -- above-described --.

UNITED STATES PATENT AND TRADEMARK OFFICE

CERTIFICATE OF CORRECTION

PATENT NO. : 6,985,686 B2
APPLICATION NO. : 10/924922
DATED : January 10, 2006
INVENTOR(S) : Ayatomo Okino et al.

It is certified that error appears in the above-identified patent and that said Letters Patent is hereby corrected as shown below:

Column 14,
Line 36, "No. 307151/2003" should read -- No. 2003-307151 --.

Signed and Sealed this

Eleventh Day of July, 2006

JON W. DUDAS
*Director of the United States Patent and Trademark Office*